US006245984B1

(12) United States Patent
Aoki et al.

(10) Patent No.: US 6,245,984 B1
(45) Date of Patent: Jun. 12, 2001

(54) APPARATUS AND METHOD FOR COMPOSING MUSIC DATA BY INPUTTING TIME POSITIONS OF NOTES AND THEN ESTABLISHING PITCHES OF NOTES

(75) Inventors: Eiichiro Aoki; Shinji Yoshihara, both of Hamamatsu; Masami Koizumi, Hino; Toshio Sugiura, Hamamatsu, all of (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/449,715

(22) Filed: Nov. 24, 1999

(30) Foreign Application Priority Data

Nov. 25, 1998 (JP) ..... 10-334566
Jan. 28, 1999 (JP) ..... 11-019625

(51) Int. Cl.[7] ..... G10H 1/40; G10H 7/00
(52) U.S. Cl. ..... 84/611; 84/635
(58) Field of Search ..... 84/611, 634, 635

(56) References Cited

U.S. PATENT DOCUMENTS 4,926,737 5/1990 Minamitaka .
5,227,574 * 7/1993 Mukaino ..... 84/652
5,256,832 * 10/1993 Miyake ..... 84/636
5,276,274 * 1/1994 Morokuma et al. ..... 84/615
5,627,335 * 5/1997 Rigopulos et al. ..... 84/635

* cited by examiner

*Primary Examiner*—Jeffrey Donels
(74) *Attorney, Agent, or Firm*—Rossi & Associates

(57) ABSTRACT

The display screen displays measure windows corresponding to the first through fourth measures for a melody to be composed. By clicking the play switch on the screen, a background accompaniment performance covering the four measures is played back to indicate the beats in the progressing tempo, thereby representing the rhythm speed. In time to the accompaniment progression, the user inputs note time points by tapping the input switch such as a space key in the keyboard to constitute a rhythm pattern for a melody progression. The measure window has a time axis in the horizontal direction and a pitch axis in the vertical direction. The tap-inputted note time points are exhibited at the corresponding positions along the time axis from left to right. Each point is dragged with the mouse pointer upward or downward to an intended pitch level, thereby establishing a pitch thereof. Alternatively, a pitch variation curve is drawn in the measure window plane to be sampled at the note time points, thereby establishing pitches of the respective note points. Only the pitches of important notes may be inputted, and the remainder may be automatically created in the apparatus according to a prepared algorithm.

34 Claims, 14 Drawing Sheets

Inputting Note Time Points

Manually Inputting All Pitches

Drawing Pitch Curve

Designating Skeletons, Remainder Created
(Skeletons Inputted Manually or Created Automatically)

P
Background Providing Window
SW1
Random
Situation
Birth Day
Love Message
Wedding Celebration
Message to Family
Christmas
Happy Message
New Year
Saint Valentine's Day
T1
1st Category
Refreshing
Tender
Lonely
Sexy
Calm
Exited
Straight
Sympathetic
T2
2nd Category
Urbane
Unrefined
Tropical
Danceable
Hard
Pop
Ethnic
Balladic
T3

*Fig.8a*

1st Category

| Adjective | Situation | Music Template Data |
|---|---|---|
| Refreshing | Birth Day | Music Template 1-1 |
| | Love Message | Music Template 1-2 |
| | : | : |
| Tender | Birth Day | Music Template 2-1 |
| | Love Message | Music Template 2-2 |
| | : | : |
| : | : | : |
| Sympathetic | Birth Day | Music Template 8-1 |
| | Love Message | Music Template 8-2 |
| | : | : |
| : | : | : |

*Fig.8b*

2nd Category

| Adjective | Situation | Accompaniment Style Data |
|---|---|---|
| Urbane | Birth Day | Accompaniment Style 1-1 |
| | Love Message | Accompaniment Style 1-2 |
| | : | : |
| Unrefined | Birth Day | Accompaniment Style 2-1 |
| | Love Message | Accompaniment Style 2-2 |
| | : | : |
| : | : | : |
| Balladic | Birth Day | Accompaniment Style 8-1 |
| | Love Message | Accompaniment Style 8-2 |
| | : | : |
| : | : | : |

APPARATUS AND METHOD FOR COMPOSING MUSIC DATA BY INPUTTING TIME POSITIONS OF NOTES AND THEN ESTABLISHING PITCHES OF NOTES

BACKGROUND OF THE INVENTION

1. Field of the Invention

The present invention relates to an apparatus and method for composing music data, and a machine readable medium containing program instructions for realizing such an apparatus and a method using a computer system, and more particularly to an apparatus and a method capable of composing music data representing a piece of music or a tune without requiring a trained skill of playing a keyboard musical instrument or other musical instruments.

2. Description of the Prior Art

Among conventionally proposed apparatuses capable of composing music data for a piece of music or a melody (tune) by simple operations, there has been such a type of apparatus in which a user inputs a short melody motif, and then the apparatus extracts characteristic features of the given melody motif and imparts a chord progression for the entire music to be composed, thereby creating a melody based on the extracted motif characteristics and the imparted chord progression. With such a type of apparatus, the user can compose a melody by merely inputting a melody motif to the apparatus.

The device for inputting a motif melody may be a keyboard or other performance operation devices for performing music in a real-time manipulation of the device, or may be a device having switches to designate note pitches and note durations in a step-by-step manipulation. In the case of a keyboard or other performance operation devices, it is difficult for beginners to input (play) even a short melody of a motif by manipulating a performance operation device such as a keyboard in a real-time musical performance. In the case of a switch arrangement for designating note pitches and note durations to constitute a motif melody, the inputting operation will be easy but it would be hard for the user to reflect the melody image he/she has in mind into the switch manipulation.

SUMMARY OF THE INVENTION

It is, therefore, a primary object of the present invention to provide a novel type of music data composing apparatus and method, and a machine readable medium containing a program therefor capable of composing music data through easy operations by the user without requiring any high level skills such as keyboard manipulation, but easily reflecting the user's melody image in a music data to be composed.

In order to accomplish the object of the present invention, one aspect of the invention provides a music data composing apparatus which comprises: an input device for inputting a sequence of note time points representing a plurality of time positions of notes defining a rhythm pattern in a musical progression by means of a tapping switch with which the user inputs the note time points by tapping operation, thereby providing data representing the sequence of note time points; and a pitch establishing device which establishes pitches of the note time points and provides data representing the established pitches of the respective note time points.

According to the above aspect of the present invention, the user can first designate a sequence of the time points constituting a rhythm pattern for a melody to be composed, i.e. the time positions of the notes of the melody to be composed, by simply tapping the switch in the intended rhythm and thereafter the pitch is given to the respective notes aligned in the rhythmic sequence. Thus, it is easy for the user to compose a melody and it is also easy for the user to reflect the melody image which the user may have in mind into the melody composed.

In this aspect of the invention, the music data composing apparatus may further comprise an automatic accompaniment performing device which stores automatic accompaniment data for automatic accompaniments and plays back the stored automatic accompaniment data presenting an automatic accompaniment to perform the automatic accompaniment for defining beat positions in a musical progression at a given tempo. With this improvement, the user can catch the tempo for a musical progression in inputting the sequence of note time points representing a rhythm pattern by tapping the tapping switch referring to the performed automatic accompaniment. The music data composing apparatus may further comprise a reference data storing device which stores melody reference data representing conditions for various kinds of melodies and stores accompaniment reference data representing conditions for various kind of accompaniment performances, a condition selecting device for selecting a desirable condition for the user from among the listed conditions, a melody creating device which creates a temporary melody based on the melody reference data of the selected condition, an accompaniment creating device which creates an accompaniment based on the accompaniment reference data of the selected condition; and an output device which outputs the temporarily created melody and the created accompaniment performance in an audible and/or visible representation to the user. With this improvement, the user has only to designate a situation and intended feeling of the melody to obtain a temporary melody piece, and thereafter can edit the temporarily created melody to compose an intended melody by altering the time positions and/or the pitches of the notes in the temporarily presented melody.

In order to accomplish the object of the present invention, another aspect of the invention provides a music data composing apparatus which comprises: an input device for inputting a sequence of note time points representing a plurality of time positions of notes defining a rhythm pattern in a musical progression by means of a tapping switch with which the user inputs the note time points by tapping operation, thereby providing data representing the sequence of note time points; a display device which displays a picture window of a coordinate plane defined by a time axis for a musical progression and a pitch axis for note pitches, and exhibits the inputted sequence of note time points in an alignment of points in the direction of the time axis; and a pitch establishing device which establishes pitches of the note time points and provides data representing the established pitches of the note time points, the pitch establishing device including a dragging device which drags an intended one of the inputted note time points in the picture window in the direction of the pitch axis and places the dragged point at a position representing a pitch in the direction of the pitch axis, thereby giving the pitch represented by the position to the dragged point.

According to the above aspect of the present invention, the user can first visually recognize the time positions of the sequence of time points for a melody, and can easily establish the pitches of the respective notes by simply dragging the note time points in the picture window in an amount corresponding to the intended pitch alteration. The location of the note points in the picture window helps the user to have a clear image of the melody ups and downs so that the user can establish the pitches of the notes easily according to the melody image the user may have in mind.

In this aspect of the invention, the pitch establishing device is so designed as to establish the pitches of the note time points by giving an individual pitch to several of the plurality of note time points by manual operations and by creating the pitches of the remainder of the plurality of note time points automatically. The note time points to which pitches can be given may be predetermined from among the inputted note time points. Thus, the user may input several, and not all, time points for the melody notes, which alleviates the inputting tasks of the user. The predetermined note time points to which pitches can be given may preferably be exhibited in the picture window in a manner different from a manner in which other note time points are exhibited, such as in size, color or shape. Then, the user can easily recognize a note time point to which a pitch can be given manually. The pitches available to be given for the notes may be limited to several of the musical scale notes according to a predetermined rule, and the dragged point may be so controlled to rest only on a pitch among the limited available pitches, for example being pulled up to the pitch which is nearest to the dragged-off position by the dragging pointer. Thus the dragging manipulation will be very easy, not requiring a precise positioning.

In order to accomplish the object of the present invention, a further aspect of the invention provides a music data composing apparatus which comprises: an input device for inputting a sequence of note time points representing a plurality of time positions of notes defining a rhythm pattern in a musical progression by means of a tapping switch with which the user inputs the note time points by tapping operation, thereby providing data representing the sequence of note time points; a display device which displays a picture window of a coordinate plane defined by a time axis for a musical progression and a pitch axis for note pitches, and exhibits the inputted sequence of note time points in an alignment of points in the direction of the time axis; and a pitch establishing device which establishes pitches of the note time points and provides data representing the established pitches of the note time points, the pitch establishing device including a pitch curve drawing device which draws a pitch variation curve in the picture window in association with the displayed note time points, the pitch curve representing a variation of pitches along the musical progression in the picture window, and including a sampling device which samples the pitch curve at the note time points, thus establishing the pitches of the intended note time points.

According to the above aspect of the present invention, the user can first visually recognize the time positions of the sequence of time points for a melody, and can easily establish the pitches of the respective notes by simply dragging the note time points in the picture window in an amount corresponding to the intended pitch alteration or by drawing a pitch variation curve in the picture window. The location of the dragged note points or the depicted pitch variation curve in the picture window helps the user to have a clear image of the melody ups and downs so that the user can establish the pitches of the notes easily according to the melody image the user may have in mind.

As will be understood from the above description about the apparatus for composing music data by first inputting time positions for the notes and then establishing the pitches of the notes for a melody, a sequence of steps each performing the operational function of each of the structural elements of the above music data composing apparatus will constitute an inventive method for composing music data according to the spirit of the present invention.

Further as will be understood from the above description about the apparatus and the method for composing music data, a storage medium containing a program executable by a computer system, which program comprising program modules for executing a sequence of the processes each performing the operational function of each of the structural elements of the above music data composing apparatus or performing each of the steps constituting the above music data composing method will reside within the spirit of the present invention.

Further as will be apparent from the description herein later, some of the structural element devices of the present invention are configured by a computer system performing the assigned functions according to the associated programs. They may of course be hardware structured discrete devices performing the same functions.

The present invention may take form in various components and arrangement of components and in various steps and arrangement of steps. The drawings are only for purposes of illustrating a preferred embodiment and processes and are not to be construed as limiting the invention.

BRIEF DESCRIPTION OF THE DRAWINGS

For a better understanding of the present invention, and to show how the same may be practiced and will work, reference will now be made, by way of example, to the accompanying drawings, in which:

FIGS. 8*a* and 8*b* are charts showing data structures of music template data and of accompaniment style data prepared in a conceptual hierarchy in an embodiment of the present invention;

DESCRIPTION OF THE PREFERRED EMBODIMENTS

Referring to the accompanying drawings, an embodiment of the present invention will be described hereinbelow.

An apparatus and a method for composing music data of the present invention have a characteristic feature in that a sequence of note time points representing a plurality of time positions of notes for a melody to be composed are inputted first to define a rhythm pattern in a musical progression of the melody, whereby data representing the sequence of note time points are provided, and in that pitches of the respective notes are then established by the user of the apparatus giving pitches to the respective note time points, while some note time points may be given pitches automatically, whereby data representing the established pitches of the note time points are provided. To begin with some examples of the process operations of the present invention will be described referring to FIGS. 1 through 5.

Figure 1:
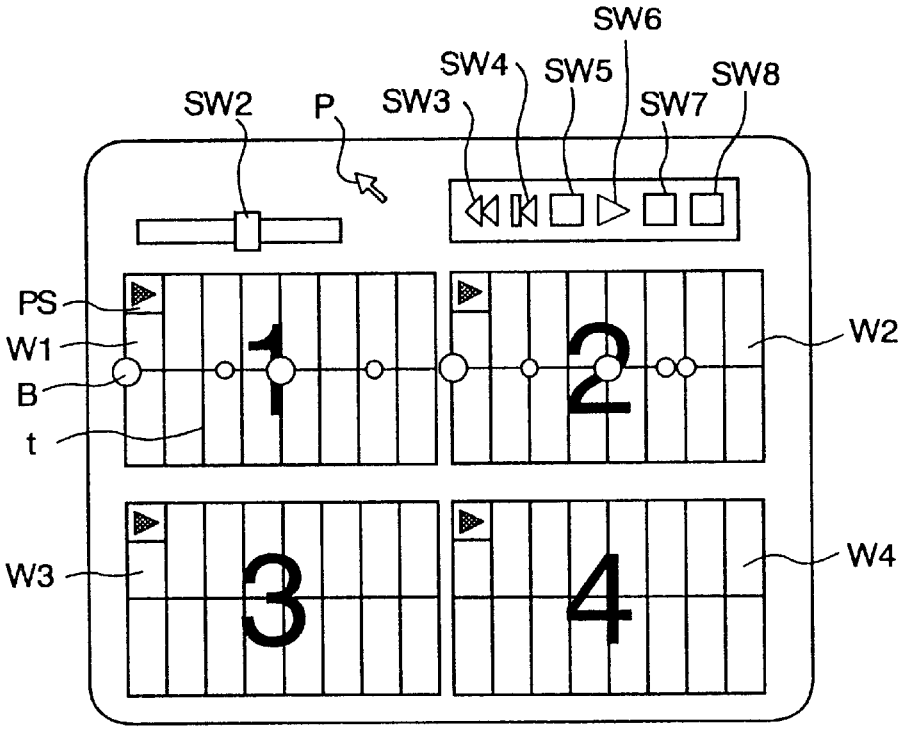
FIG. 1 is an example of a melody input window on a display screen during the execution of the processing for inputting all note time points manually with an embodiment according to the present invention.

FIG. 1 is an example of a melody input window on a display screen during the execution of the processing for inputting all note time points manually, and shows four measure windows W1–W4 having big numerals "1" through "4" as a wallpaper sign corresponding to four measures, W1 showing the first measure, W2 the second measure, W3 the third measure and W4 the fourth measure, each in its state under the input processing. In the area above the windows W1 and W2 are an image switch SW2 for setting the tempo of the music, a backward switch SW3 for the background music performance and the melody performance, a head-search start switch SW4, a stop switch SW5, a play switch SW6, a manipulation cancel switch SW7 and a NEXT switch SW8 for calling the succeeding measures.

Each of the measure windows W1–W4 is depicted with the time axis in the horizontal direction and the pitch axis in the vertical direction vertical lines t within each window representing time positions with respect to the beats in the measure. FIG. 1 shows the state under processing in which the note time points have been inputted for the first and second measures SW1–SW2. The inputted points are indicated with blank circles B at the positions corresponding to the time and the pitch of the notes. In this example, the note time points inputted by tapping operation are aligned horizontally and define rhythmic time positions of the notes but the pitches thereof are temporarily set at a conveniently predetermined reference pitch such as the same note as the root note of the chord assigned to the measure in the chord progression of the music. Thus determined notes will be sounded by means of some sound system for further operation by the user. In the illustrated example, the root note of the chords for these four measures in the chord progression of the music are the same. When inputting the time points by tapping the particular switch, the background music performance (such as a chord accompaniment) is played back for the convenience of the user to catch the rhythmic tempo of the music by manipulating the play switch SW6, and the background performance is to be repeated over and over for the four displayed measure windows W1–W4, until the stop switch SW5 is actuated. Therefore, when the user notices erroneous input, the last tapping at such an erroneous portion overwrites the former errors. Further, deficient points may be added posteriorly and excess points may be deleted posteriorly. The positions in the time axis are quantized (e.g. in sixteenth note duration steps) and therefore the note time points will be adequately positioned with respect to the rhythm beats of the music, even though the actually inputted time positions may be unconsciously fluctuated in some small amount. Deletion of any intended point can be easily effected. The input operation by tapping is very easy for the user.

Figure 2:
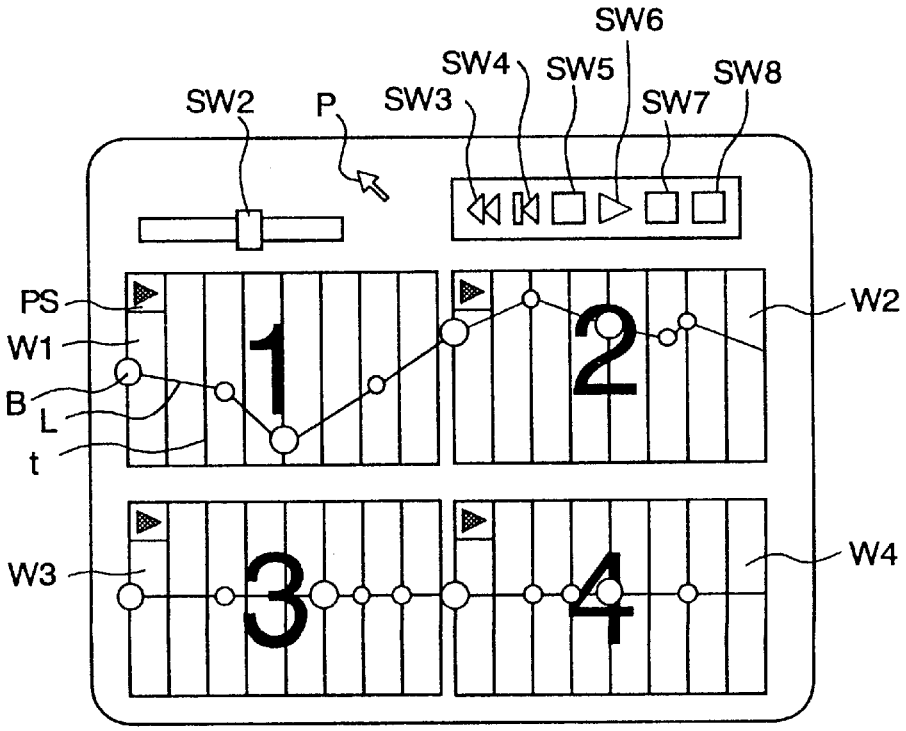
FIG. 2 is an example of a melody input window on a display screen during the execution of the processing for establishing pitches of the note time points.

FIG. 2 shows an example of a melody input window with four measure windows on a display screen during the execution of the processing for establishing pitches of the note time points. The measure windows W1–W2 are in the state that the pitches for all note points have been established, with blank circles B placed at the respective pitch positions and connected with a line L to indicate an overall variation of pitches to make a melody. The measure windows W3–W4 are in the state that the note time points have been inputted but no pitches have been established yet. The operations in the screen window image to establish the note pitches is described more specifically with reference to FIGS. 3*a*–3*d*.

Figure 3A:
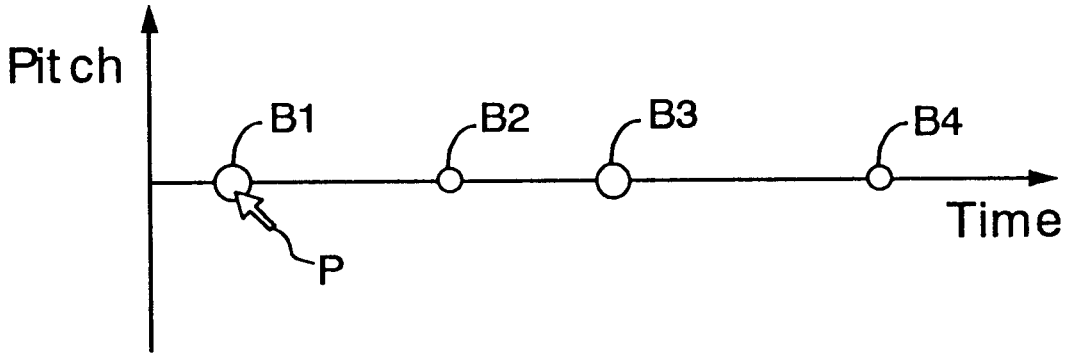
FIGS. 3*a*–3*d* show examples of operations in the pitch establishing processing in an embodiment of the present invention.
Figure 3B:
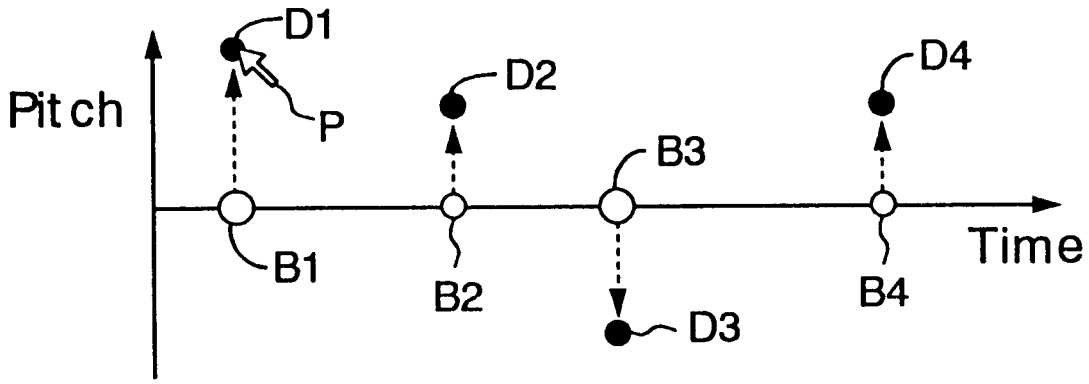
Figure 3C:
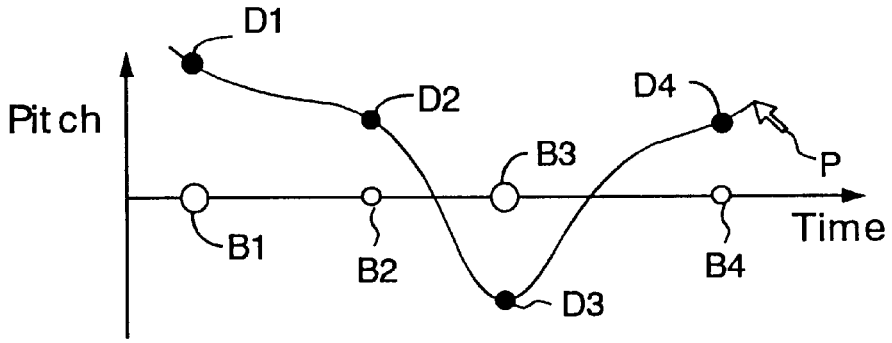
Figure 3D:
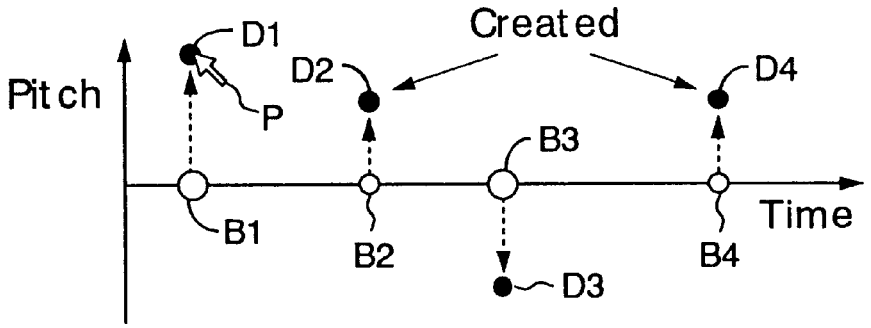

FIGS. 3*a*–3*d* show examples of operations in the processing of establishing the note pitches, each showing the processing in one measure for the sake of simplicity. FIG. 3*a* depicts the state that four time points have been inputted by tapping operations. Blank circles B1–B4 along the horizontal line (representing the reference pitch as well as the time axis) indicate time positions of the notes as inputted. The larger circles B1 and B3 indicate skeleton notes or primary notes which will have important roles in a melody to be composed from the viewpoint of beat strength (down beats or up beats) in the music progression, and the smaller circles B2 and B4 indicate non-skeleton notes (may be called "flesh notes" in contrast to "skeleton notes") or secondary notes which are less important in constructing a melody. FIG. 3*b* illustrates the case of inputting all the pitches manually. As the inputted circle B1 is dragged by the mouse pointer P in the vertical direction up to the position D1 (solid circle), the pitch of this note is decided at the level of the circle D1 (e.g. four semitones above the reference pitch). The rest of the points B2–B4 are likewise given the respective pitches as shown by solid circles D2 (e.g. two semitones above the reference pitch), D3 (e.g. three semitones below the reference pitch) and D4 (e.g. two semitones above the reference pitch). FIG. 3*c* illustrates the case of drawing a pitch curve in the window according to the locus of the mouse pointer P, the pitch curve representing a general pitch variation pattern for an intended melody. As the pitch curve C is drawn in an intended window (W1, W2, . . . ), the curve locus is sampled at the respective time points of the circles B1–B4 to obtain pitch-imparted solid circles D1–D4 along the line C. The pitches to be established are the actually existing pitches in the musical scale by quantizing each of the values on the locus C to the nearest pitch in the simitone step or in the diatonic scale step of the prevailing key (tonality). FIG. 3*d* illustrates the case of inputting the pitches of the skeleton notes manually as performed both in a process step for inputting all the skeleton notes manually and in a process step for creating skeleton notes automatically. The pitches of the skeleton notes B1 and B3 are determined by dragging the mouse pointer P to locate at the solid circles D1 and D3 just like in the case of FIG. 3*b*, but the non-skeleton notes B2 and B4 are created automatically (according to the processing program) to locate at the solid circles D2 and D4 with reference to (based on) the pitch-inputted skeleton notes D1 and D3.

As is apparent from FIGS. 3*a*–3*d* above, the difference in size of the circles between the skeleton notes and the non-skeleton notes are very convenient for the user to recognize the importance of the respective notes in the melody, especially when the user establishes the pitches of the skeleton notes only. The distinction of the two kinds of notes may be otherwise, such as the difference in color and the difference in shape (circle, triangle, square). Other differentiation may of course be applicable. The pitch determinable points may be highlighted in exhibition such as by blinking.

The measure windows W1–W4 each include a play switch PS, which when clicked causes to perform the melody fraction of the measure so far composed. When the NEXT switch SW8 is clicked, the screen displays the next four measures (e.g. W5–W8, not shown) further to continue the inputting operations in a similar manner.

Figure 4:
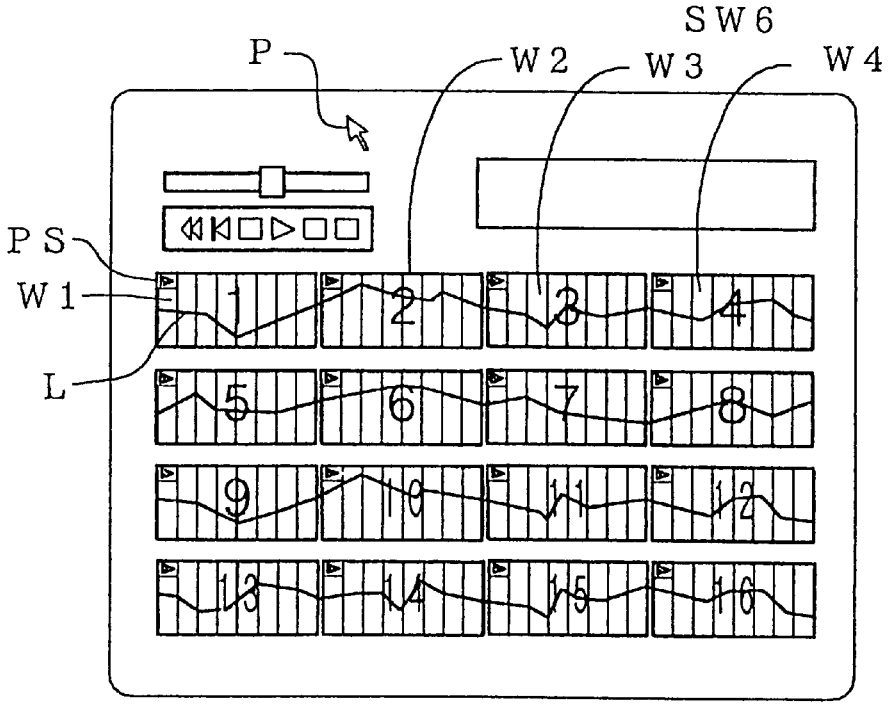
FIG. 4 shows an example of a melody exhibiting window on a display screen during the execution of the processing for displaying a completed melody to edit the same in an embodiment of the present invention.

FIG. 4 shows an example of a melody exhibiting window on a display screen during the execution of the processing for displaying a completed melody in the amount of one chorus (in this example, sixteen measures) to edit the melody. The melody flow (note pitch variation) is exhibited in the form of a line L. When the user wants to amend the melody fraction in a certain measure, the user clicks that measure window (W1, W2, . . . ), the screen goes back to the pitch inputting window having four measure windows (e.g. FIG. 2).

Figure 5:
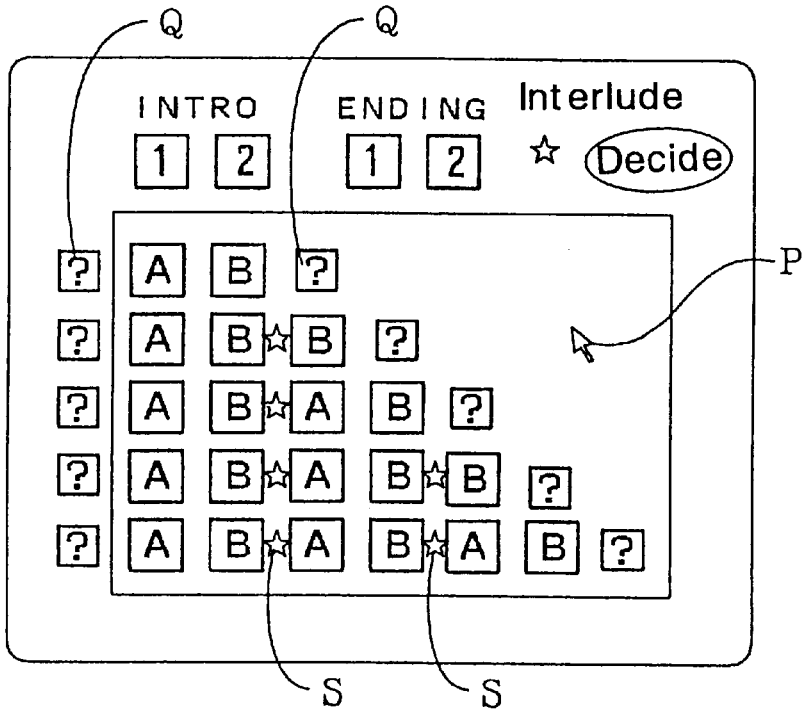
FIG. 5 shows an example of a music structure setting window on a display screen during the execution of the processing for deciding a music structure from the completed melody in an embodiment of the present invention.

FIG. 5 shows an example of a music structure setting window on a display screen during the execution of the processing for deciding a music structure from the completed melody in the amount of one chorus. The melody composed in the amount of one chorus is divided into two portions, a theme portion A and a bridge (or release) portion B, and the displayed window presents five templates representing five different examples of a combination of those portions A and B. Each horizontally aligned sequence such as A-B-B constitutes a template. Once a sequence is determined and selected, the user selects an introduction (1 or 2) to be employed in the top (left end) "?" mark Q on the selected template and an ending (1 or 2) to be employed in the tail (right end) "?" mark Q on the selected template, and further selects the location for an interlude of a star mark S to be inserted (location candidates are predetermined and shown). The interlude is, for example, a four-measure fraction of performance constituted mainly by a rhythm pattern by percussion instrument tones without a melody. These selections are effected by clicking the intended points in the screen by a mouse pointer P.

Figure 6:
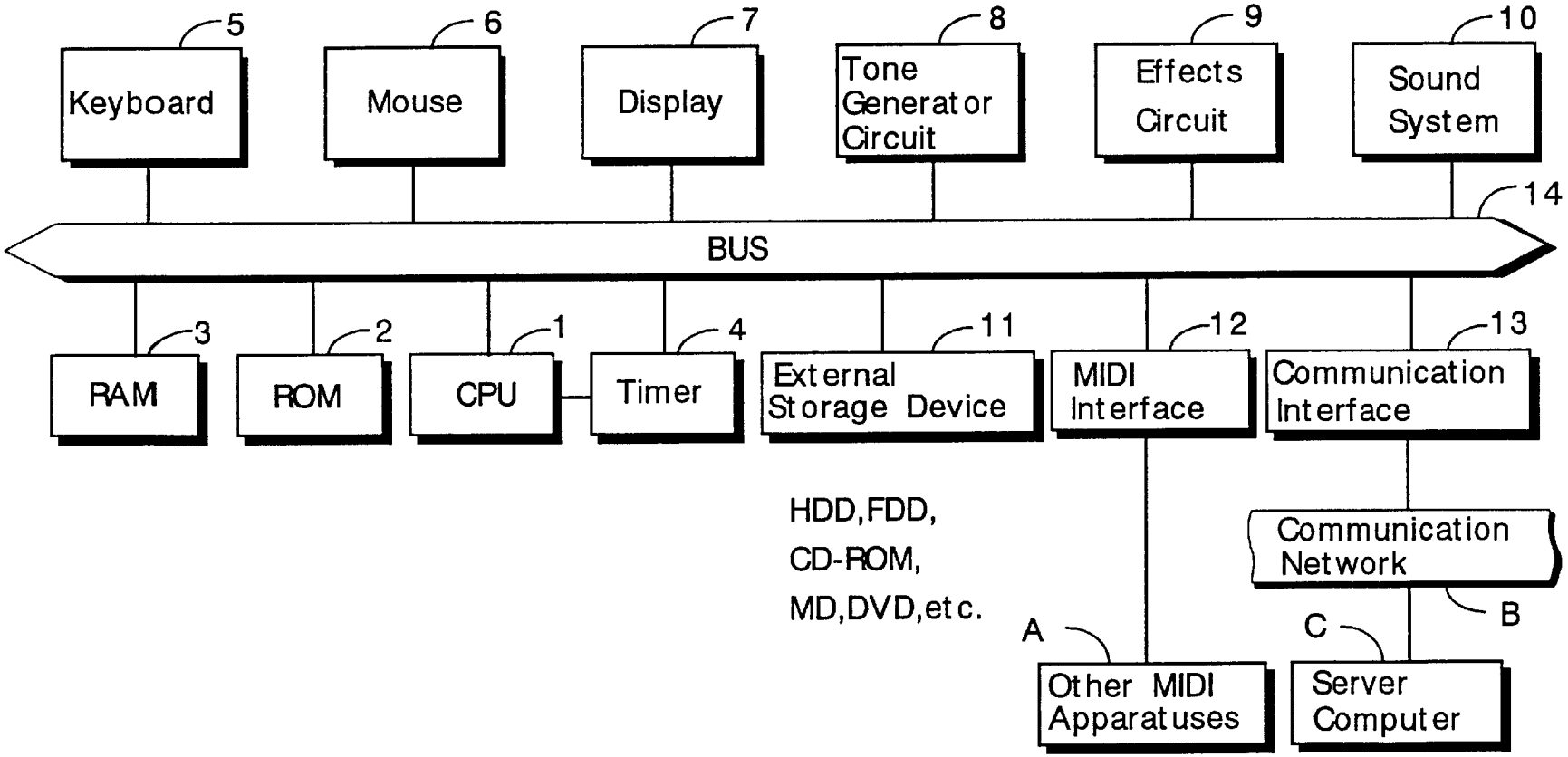
FIG. 6 is a block diagram illustrating the configuration of an embodiment of a music data composing apparatus according to the present invention.

FIG. 6 is a block diagram showing a hardware structure of an embodiment of a music data composing apparatus according to the present invention as configured by a personal computer and associated software. The personal computer comprises a CPU 1, a ROM 2, a RAM 3, a timer 4, a keyboard 5, a mouse 6, a display 7, a tone generator circuit 8, an effects circuit 9, a sound system 10, an external storage device 11, a MIDI interface 12, a communication interface 13 and a bus 14. The tone generator circuit 8, the effects circuit 9 and the MIDI interface 12 are packaged in sound cards or the like. Although omitted in the FIG. 6, the apparatus is equipped with an output device such as a printer (although not shown) to conduct various printing processes.

The CPU 1 executes ordinary controls using, working areas in the RAM 3 according to an OS (operating system) installed, for example, in a hard disk drive (HDD) of the external storage device 11. More specifically, the CPU 1, for example, controls displaying on the display device 7, inputs data in response to the operation of the keyboard 5 and the mouse 6, controls the position of the mouse pointer (cursor) in the screen of the display 7, detect clicking manipulations of the mouse 6, and so forth. Thus, the input operation and the setting operation by the user are processed by means of so-called graphical user interface (GUI) using the image presentation on the display 7 and the human control by the mouse 6. A particular key in the keyboard 5 (e.g. space key) is assigned for inputting the note time points (the time points of sounding tones for a melody or an accompaniment) by tapping the key in a rhythm pattern consisting of note positions along the time axis (time lapse). The tone generator circuit 8 generates tone signals according to the data (e.g. performance information) supplied from the CPU 1, the effects circuit 9 imparts various sound effects to the tone signals, and the sound system 10 including an amplifier and a loudspeaker generates musical sounds.

The external storage device 11 may be a hard disk drive (HDD), a floppy disk drive (FDD), a CD-ROM drive, a magneto-optical disk (MO) drive. a digital versatile disk (DVD) drive and so forth, and supplies a music data composing program for the present invention. The external storage device is also used for storing composed music data, and further for storing various database including music template data and accompaniment style data as basic information for composing music data. The MIDI interface 12 is for transferring various data to and from other MIDI apparatuses A so as, for example, to output the composed melody in the form of MIDI data to play back by the MIDI apparatus A.

Further, the system can be connected to a communication network B via the communication interface 13 to receive various data such as the music data composing program, music template data and accompaniment style data of the present invention from a server computer C via the communication network B. Also the composed music data files can be transmitted to a connected user, for example, as a birthday present via the communication network B. In the preferred embodiment described herein, the music data composing program, the music template data and the accompaniment style data are stored in a hard disk drive (HDD) of the external storage device 11, and the CPU 1 develops the music data composing program in the hard disk drive (HDD) onto the RAM 3 and controls the operation of the automatic composition of the music data according to the program on the RAM 3.

Figure 7:
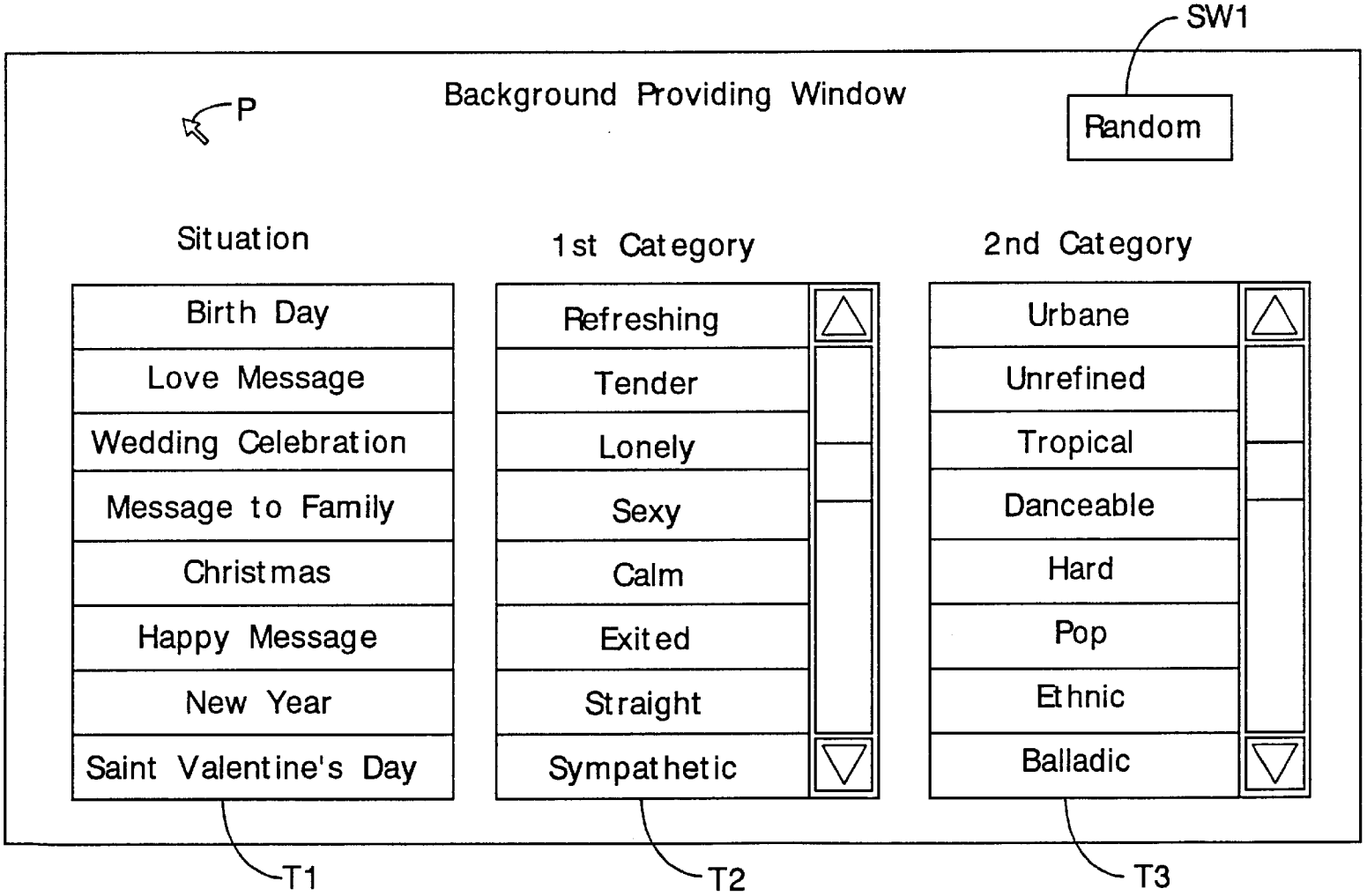
FIG. 7 shows an example of a background providing window in am embodiment of the present invention.

FIG. 7 shows an example of a background providing window as a preceding stage to the music data composing stage in an embodiment of the present invention. Various windows which will be described hereinafter are to refer to window exhibitions on the screen of the display device 7. In the window picture for the background performance providing process, there are a mouse pointer P which moves according to the manipulation of the mouse device 6 and lists of items to be selected by clicking the mouse 6 and switch buttons to be commanded by clicking the mouse 6. The lists include a situation selection table T1 including items of adjectival words of situations (e.g. "Birthday", "Love Message", etc. as shown in FIG. 7) representing the situations for which the music to be composed will be dedicated, a first category selection table T2 including adjectival words of adjectives (e.g. "Refreshing", "Tender", etc. as shown in FIG. 7) representing the types of music prepared as the music template data, and a second category selection table T3 including adjectival words of adjectives (e.g. "Urbane", "Unrefined", etc. as shown in FIG. 7) representing the styles of the musical accompaniment prepared as the accompaniment style data. Also exhibited on the window is a random switch SW! for designating random selection of the situation the first category and the second category.

By selecting an intended item in each of the selection tables T1–T3 by placing the mouse pointer P and clicking the mouse button, one item from each of the situation, the first category and the second category is designated according to the user's selection. When the random switch SW1 is clicked, one item form each of the tables T1–T3 is selected randomly (just like in the case of a slot machine). Then, according to such designated items, a background performance music piece (e.g. a chord accompaniment and/or a rhythm accompaniment) is created for a melody to be composed. The selection of the respective items in the tables T1–T3 and the activation of the random switch SW1 may not necessarily be conducted by the clicking operations of the mouse 6, but may be conducted by the key depressing operations of some particularly assigned keys in the keyboard 5.

FIGS. 8*a* and 8*b* are charts showing data structures of music template data and of accompaniment style data prepared in a conceptual hierarchy in an embodiment of the present invention, in which FIG. 8*a* shows how the music template data are prepared for the respective situations as listed in the table T1 of FIG. 7 with respect to the first category adjectives, while FIG. 8*b* shows how the accompaniment style data are prepared for the respective situations with respect to the second category adjectives.

Each set of music template data (i.e. music template data 1-1, music template data 1-2, . . . , music template data 2-1, . . . ) includes chord sequence data, melody skeleton data, rhythm imitate/contrast data, pitch imitate/contrast data, section sequence data and so forth each in an amount for one chorus of music. One chorus herein consists of, for example, thirty-two (32) measures. The melody skeleton data are data defining pitches to be given to skeleton notes in a melody. The skeleton notes herein means primary or important notes in the melody progression, positioned at the time points such as the head of a measure and the time points of the down beats (strong beats) in a measure. The imitate/contrast data are data representing the manner of forming the rhythm or melody progression, whether by imitating the motif rhythm or melody or by contrasting against the motif rhythm or melody. The section sequence data are data indicating the manner of connecting the respective sections of the accompaniment style data.

Each set of accompaniment style data (i.e. accompaniment style data 1-1, accompaniment style data 1-2, . . . , accompaniment style data 2-1, . . . ) includes automatic performance pattern data for a plurality of performance parts such as a rhythm part, a bass part background part, and so forth, and is comprised of plural sections such as an introduction-1, an introduction-2, a main-1, a main-2, a fill-in, an interlude, an ending-1, an ending-2, and so forth. The length of one section may preferably be one through six measures, where the length of an interlude is fixed as four measures in the embodiment. Each accompaniment style data is set with an individual standard tempo. Each accompaniment pattern is prepared with a predetermined reference chord (e.g. C major), and the chord constituent notes are to be modified (altered in pitch) to constitute a given chord at the time of playing back the accompaniment.

As shown in FIGS. 8*a* and 8*b*, the first category of adjectives indicate atmospheric feelings and are for determining a music template to be employed, and the second category of adjectives indicate music types and are for determining an accompaniment style to be employed. With respect to each of the adjectives in the first categories, there are prepared music templates for the respective situations, each template representing a melody of the content and feeling which match each designated situation. And with respect to each of the adjectives in the second categories, there are prepared accompaniment styles for the respective situations, each style representing a melody of the content and feeling which matches each designated situation. Thus, adjectives are to properly represent the respective features of the music templates and the accompaniment styles. Therefore, even for the same situation, the different adjectives provide different music templates and different accompaniment styles. For example, the music template data for the same situation of "birthday" are different between for "refreshing" and for "tender". Likewise, from another aspect, the music template data for the same adjective of "refreshing" are different between for "birthday" and for "love message". The same is true with the accompaniment data. Of course, a same template or a same accompaniment style may be commonly allotted for some plural situations and adjectives. Various known technology may be utilized for generating an accompaniment on the basis of the template data and the style data. An accompaniment may be prerecorded as a whole for a piece of music corresponding to each combination of the adjectival words (situation, 1st category adjective and 2nd category adjective), or may be created by some program based on the template data and the style data as nominated by the selections of the adjectival words (situation, 1st category adjective and 2nd category adjective). The created accompaniment data are stored in the apparatus for the further use such as audible presentation and data transmission.

FIGS. 9–12 are flow charts showing the processing in the music data composing program of the present invention executed by the CPU 1, of which the control operations will be described hereunder in detail referring to each figure.

Figure 9:
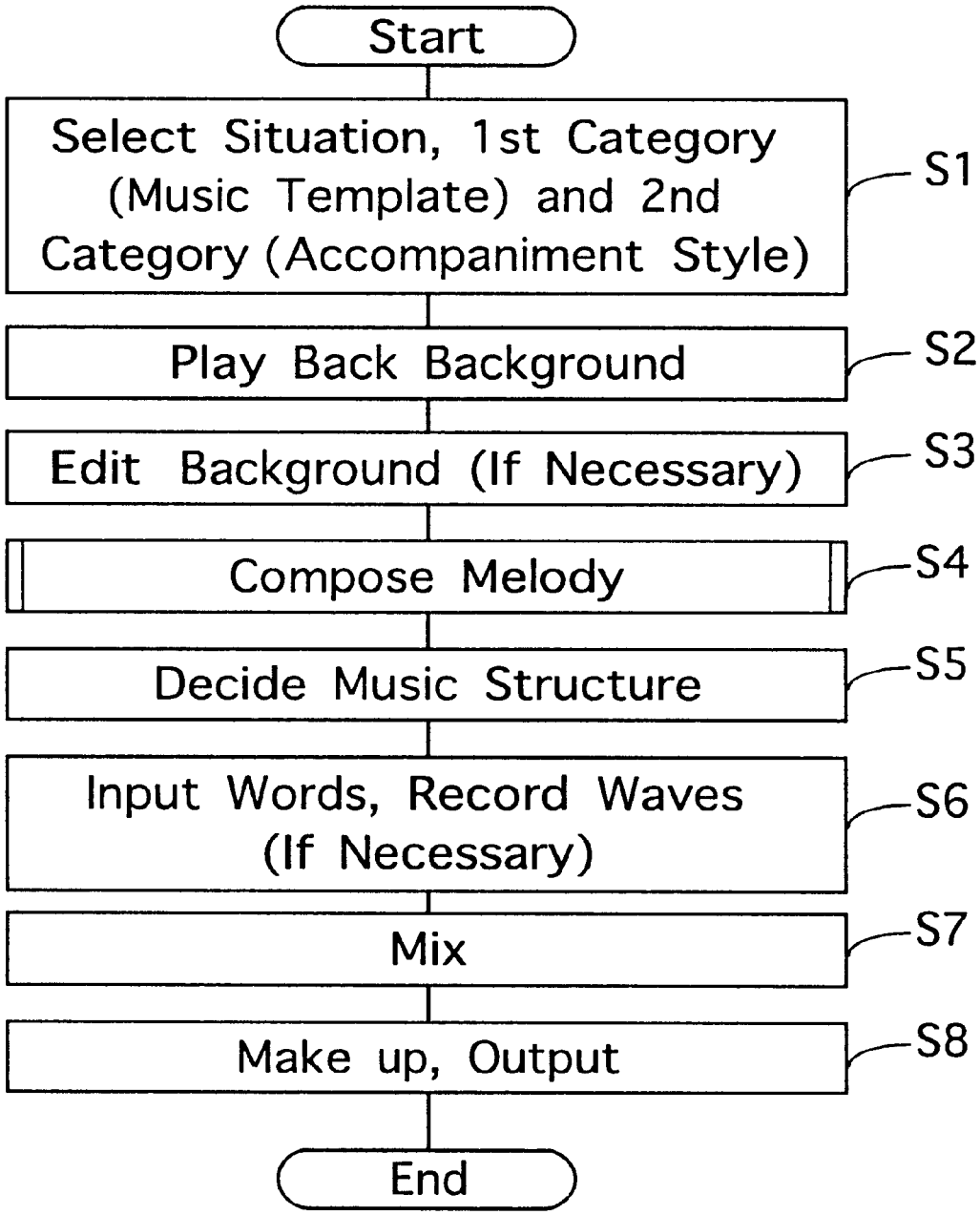
FIG. 9 is a flow chart showing the main routine of the processing under a music data composing program in an embodiment of the present invention.

FIG. 9 shows the main routine of the music data composing processing in an embodiment of the present invention. Upon start of the processing by the music data composing program the first step S1 conducts a selection process of selecting an appropriate music template by designating a situation and an adjective of the first category and of selecting an appropriate accompaniment style by designating a situation and an adjective of the second category. These selections are conducted by nominating desired one of the plural situations, desired one of the plural adjectives in the first category and desired one of the plural adjectives in the second category, or by actuating the random switch SW1 in the background providing window of FIG. 7 by means of the mouse manipulation or the keyboard manipulation as described hereinbefore.

The next step S2 is a process of playing back a background performance as conducted when the play switch SW6 is clicked in the process window of FIG. 1 or 2. In this process, a background performance which is an automatic accompaniment is generated and played back based on the chord progression data and the section progression data contained in the music template data as determined according to the selected situation and the selected adjective in the first category, and based on the accompaniment style data as determined according to the selected situation and the selected adjective in the second category. The data of the generated accompaniment are stored in the apparatus to be read out for the playback. The tempo for the playback is the standard tempo prescribed in the accompaniment style data. The background performance will be conducted, for example, in a sequence of sections such as "the main 1 of fifteen measures, the fill-in of one measure and then the main 2 of sixteen measures.

A step S3 is an arbitrary one and is to be performed in case of necessity to edit the background performance data such as to set the tempo or the transposition, and to modify the chord progression and the section progression in the music template data or the accompaniment style data. A step S4 is the processing of composing a melody using either a method of inputting all note time points manually or a method of creating note time points automatically (i.e. a few of the time points are inputted manually and the remainder are created automatically) as described in detail hereinafter with reference to FIG. 10. A melody composed on the basis of the automatically inputted time points may thereafter be modified partly. Then, the process proceeds to a step S5.

The step S5 is to decide the structure for a melody to be composed by dividing the whole melody in the amount of one chorus of thirty-two measures into a first half of sixteen measures as a theme part (A) and a second half of sixteen measures as a bridge (or release) part (B) and deciding the combination manner of A's and B's as described above with reference to FIG. 5. A step S6 is also an arbitrary one and is to be performed in case of necessity to input the words (lyrics) and to record the song (waves). A step S7 is the mixing process which set the tone colors of the musical instrument to be used, the effects to be imparted, the volume of the notes of the melody, etc. The composed melody data is stored in the apparatus for use in the data processing. A step S8 is the process of making up and output of the composed melody in accordance with the output forms of the composed music data. In the make-up process and the output process, the user selects the method for outputting the composed data, upon which labels and data to match the selected method are formed and such formed labels and data are outputted to the intended destination. For example, when the output method is "a present by an e-mail" using a communication network, a music data file is made together with an appropriate icon and then the e-mail transmitting process takes place. If the output method is "a present by a floppy disk", a label for a floppy disk will be printed. If the output method is "a present by a cassette tape or an MD", a label for a cassette tape or an MD will be printed. If the output method is "a BGM in the home page", a music data file is compiled and will be uploaded to a WEB server.

Figure 10A:
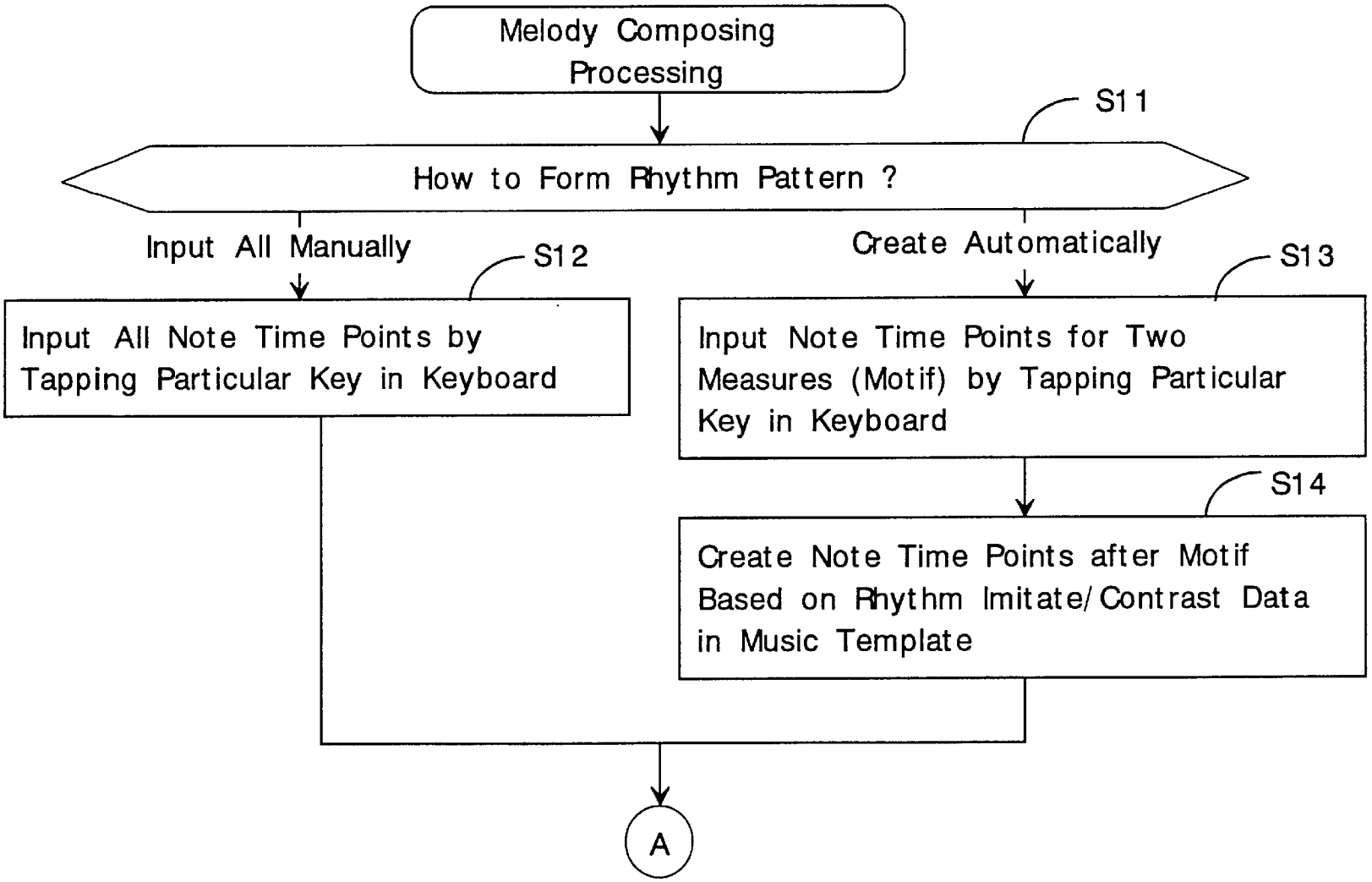
FIGS. 10*a* and 10*b* are, in combination, a flow chart showing the melody composing processing.
Figure 10B:
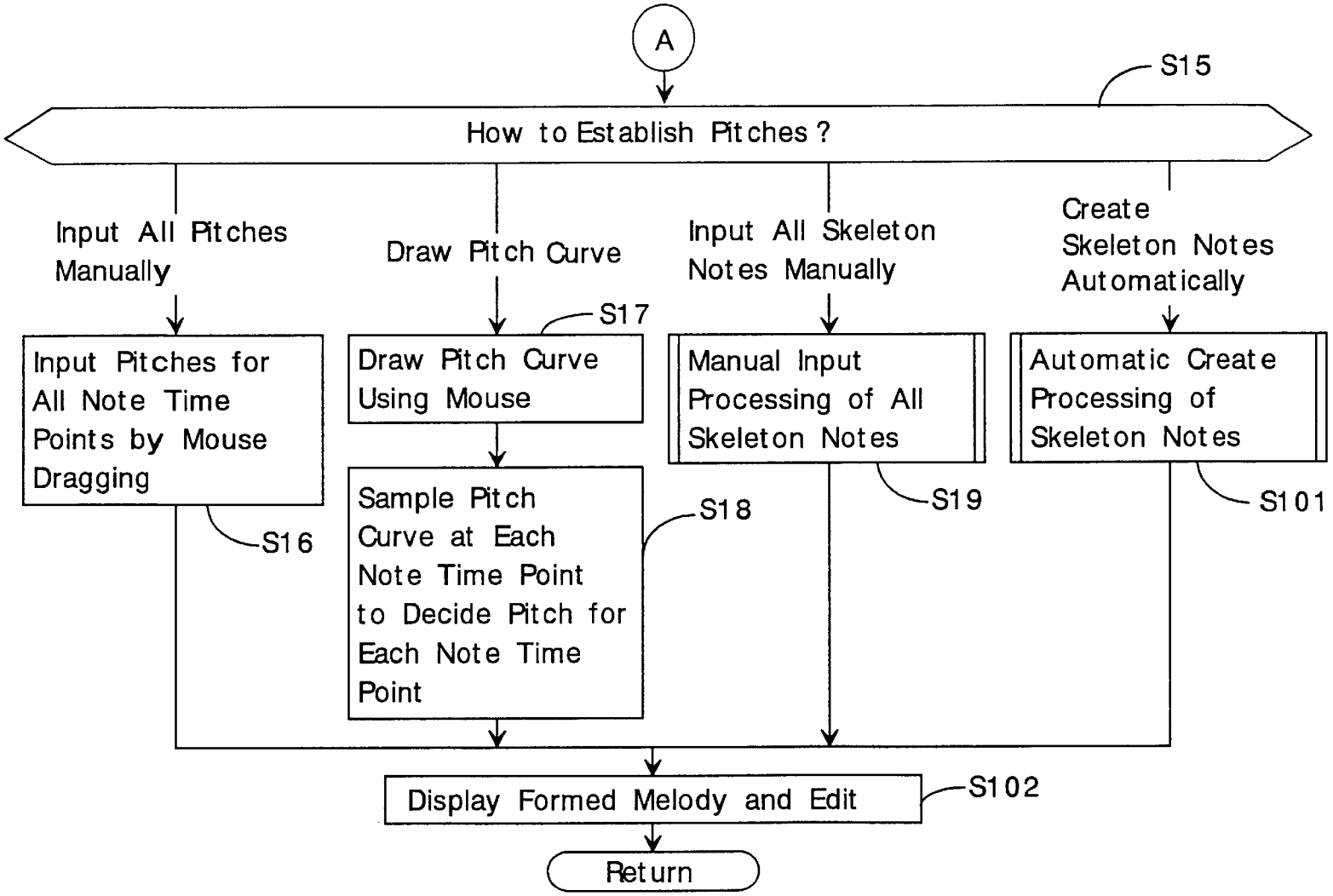

FIGS. 10*a* and 10*b* show, in combination, a flow chart of the melody composing processing at the step S4 in FIG. 4. In FIG. 10*a*, the first step S11 here is to judge which method is selected by the user for forming a rhythm pattern of the user's intent, a method of inputting all note time points manually or a method of creating note time points automatically. When the method of inputting all note time points manually is selected, the process moves forward to a step S12 for the process of inputting all note time points by tapping a particular key (e.g. a space key) in the keyboard 5 (see also FIGS. 1 and 3*a*), before moving forward to a step S15 in FIG. 10*b*. The inputted note time points are exhibited in the measure window in a manner as depicted in FIG. 1 and FIG. 3 When the method of creating note time points automatically is selected, the process moves forward to a step S13 for the process of inputting note time points for two measures (motif) by tapping the particular key in the keyboard assigned for tapping a rhythm pattern (so far inputted note time points are exhibited in the measure windows as shown FIG. 1) and then to a step S14 for creating note time points after the motif based on the rhythm imitate/contrast data in the music template data before moving forward to the step S15. In order for the user to input the note time points in the step S12 or step S13 by tapping the particular assigned key, a background performance (provided as described above) had better be played back as in the case of the step S2 above. In the case of the step S12, the background performance of the length of four measures are played back and in the case of the step S13, the background performance of the length of two measures are played back (repeatedly if necessary).

The process of automatically creating the note time points will be described in more detail hereunder. The rhythm imitate/contrast data is the data to regulate whether the rhythm patterns for the remainder measures after the first two inputted measures are created by imitating the rhythm pattern of the inputted two measures or by contrasting with the inputted rhythm pattern of the first two measures. In the case of "imitate", rhythm patterns which are the same as or similar to the inputted rhythm pattern will be created, while in the case of "contrast", rhythm patterns which exhibit some contrast against the inputted rhythm pattern will be created. The rhythm imitate/contrast data may be a data sequence of selected ones from among "identical", "imitate", "contrast" and "random (any of the preceding three will be employed randomly)", for example, for every two measures through one chorus of music, or may be a data hierarchy representing one chorus of music in the form of block (A and B)/sentence (1st through 4th)/phrase (1st and 2nd) and indicating whether the block B is to imitate the block A/sentence symbol (such as A, A', B and C indicating the resemblance degrees) for 1st through 4th sentences/whether the second phrase is to imitate the first phrase, or may be of various data formats.

The manners of creating a rhythm pattern which is similar to the given motif and a rhythm pattern which is in contrast with the given motif will be as follows. Rhythm patterns of two-measure length having similar musical features (e.g. with a syncopation) are grouped, and there are prepared a number of groups. And in association with each group, there is also prepared a group of rhythm patterns of two-measure length having musical features (without a syncopation) in contrast with the above group feature. When a similar rhythm pattern is to be created, the process step searches for a group which includes a rhythm pattern which is identical with the inputted two-measure rhythm pattern and selects another rhythm pattern in the same group as a similar rhythm pattern. When a contrastive rhythm pattern is to be created, the process step searches for a group which includes a rhythm pattern which is identical with the inputted two-measure rhythm pattern and selects a rhythm pattern from the group contrastively associated with the searched-out group as a contrastive rhythm pattern. As an identical rhythm pattern the inputted rhythm pattern itself will be employed.

When the above processing for determining all the note time points defining a rhythm pattern is completed pitches will be established for the respective note time points using the processing from a step S15 and onward of FIG. 10*b*. The step S15 is to judge which method is selected by the user's operation for establishing pitches for the respective note time points from among the methods of "manually inputting the pitches of all the note time points", "drawing a pitch curve", "manually inputting the pitches of all the skeleton notes" and "automatically creating the pitches of the skeleton notes". When the method of manually inputting the pitches of all the note time points is selected, the process proceeds to a step S16 for inputting pitches of all the note time points by the mouse dragging in a manner as depicted in FIG. 3*b,* before moving forward to a step S102. When the method of drawing a pitch curve is selected, the process proceeds to a step S17 for drawing a pitch curve (pitch variation curve) according to the manipulation of the mouse 6 and then a step S18 samples the pitch curve at each note time point to decide the sampled pitch as the pitch for the note time point in a manner as depicted in FIG. 3*c,* before moving forward to the step S102. In case the selected method is the method of manually inputting all skeleton notes, the process proceeds to a step S19 to perform the processing of manually inputting all skeleton notes, before moving forward to the step S102. In the case of the method of automatically creating the skeleton notes, the process proceeds to a step S101 to perform the processing of automatically creating the skeleton notes, before moving forward to the step S102. The step S102 displays the thus formed melody and the user may edit the displayed melody if necessary. And the process flow returns to the main routine of FIG. 9 to move forward to the step S5.

Figure 11:
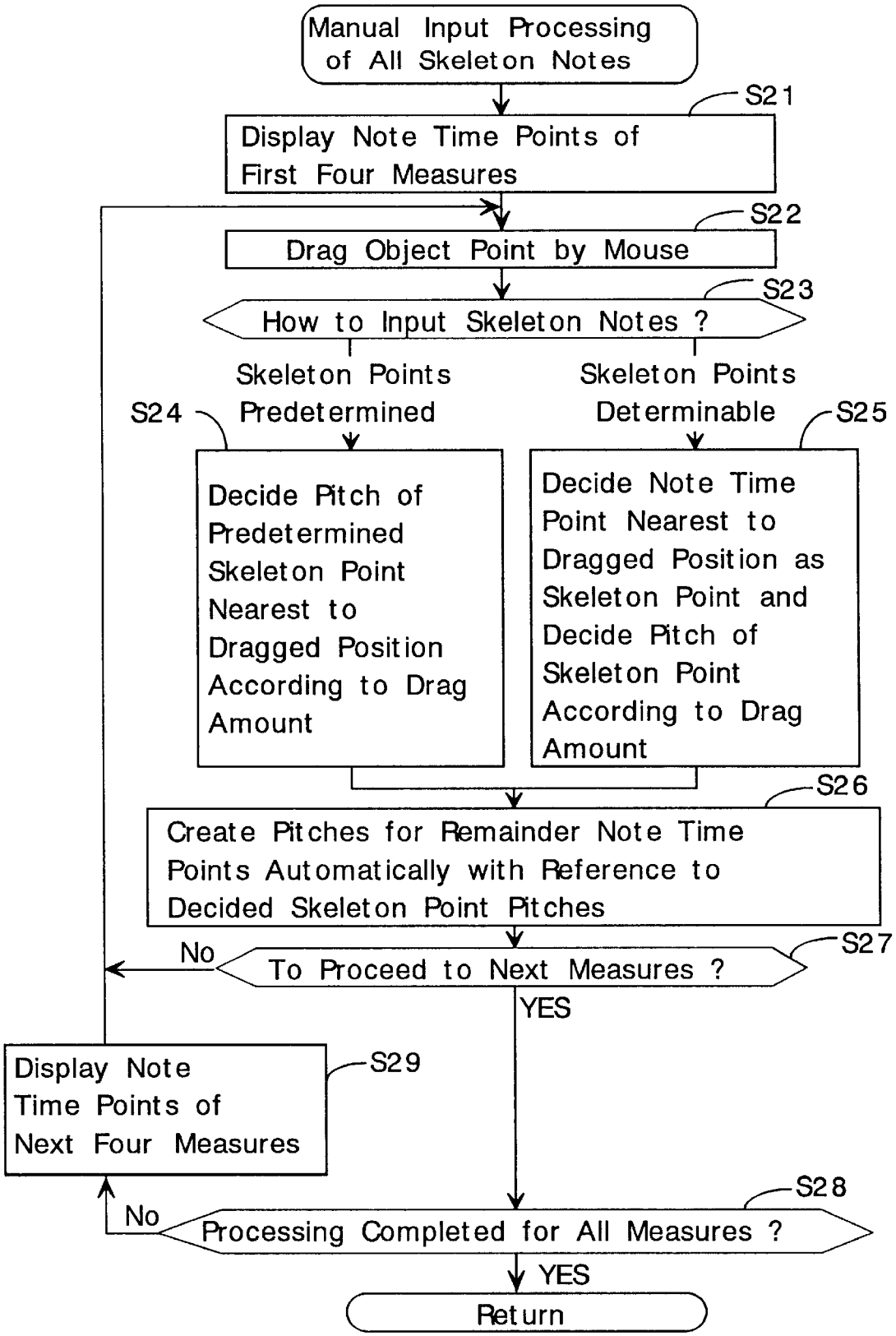
FIG. 11 is a flow chart showing the processing of manually inputting all skeleton notes.

FIG. 11 shows a flow chart of the processing of manually inputting all skeleton notes. The first step S21 displays the note time points (inputted or created) of the first four measures on the display window as shown by the blank circles B1–B4 in FIG. 3*d.* A step S22 conducts the processing in response to the user's manipulation of the mouse 6 dragging an intended object point (position on the screen), e.g. the big hollow circles B1 and B3, to an intended direction, e.g. the solid circles D1 and D3 in FIG. 3*d.* A step S23 judges whether the user has selected a method of inputting the skeleton notes (i.e. establishing the pitch of the skeleton note) under the condition that the time points of the skeleton notes are predetermined or a method of inputting the skeleton notes under the condition that the time points of the skeleton notes are flexibly determinable. If the step S23 judges that the method with the predetermined skeleton points is selected, a step S24 decides the pitch of the skeleton point (limited to a skeleton point) which is nearest to the dragged object position (designated position to be dragged, i.e. position before dragging) among the predetermined skeleton points according to the amount of the dragging, before the process moves forward to a step S26. If the step S23 judges that the method with the determinable skeleton points is selected, a step S25 first decides the note time point (whether or not a skeleton point) which is nearest to the dragged object position as a skeleton point and then decides the pitch of such a skeleton point according to the amount of the dragging, before the process moves forward to the step S26. Thus, through the step S24, as the time points which have been previously determined properly from a musical point of view become the skeleton points, the composed music data will be of a high degree of perfection, while through the step S25, as the time points which are arbitrarily decided by the user become the skeleton points, the composed music data will be of a high degree of flexibility.

The step S26 creates (establishes) the pitches for the remainder of the note time points as shown by the solid circles D2 and D4 in FIG. 3*d* automatically with reference to the decided pitches of the skeleton points as shown by the solid circles D1 and D3. Then, a step S27 judges whether to proceed to the next four measures according to the user's intention. When the user does not want to go further to the succeeding four measures, the process goes back to the step S22, but when the user wants to go further to the succeeding four measures, the process moves forward to a step S28 to judge whether the processing has been completed for all the measures or not. If not, a step S29 displays the note time points of the next four measures, before going back to the step S22.

In the processing of FIG. 11 as described above, when the note time points are displayed for the first four measures (S21) or for the succeeding four measures (S29), those points are placed on a horizontal line representing a reference pitch (all points at same pitch), which may be a middle pitch (e.g. F4 note of 349 Hz) of the note range of a typical melody, or may be the pitch of the root note (e.g. C4 note of 262 Hz) of the chord (e.g. C major) for the corresponding span (e.g. measure) in the assigned chord sequence. The points are connected with each other with a line on the screen. FIG. 3*a* is an illustration of four note time points (blank circles) B1–B4 connected together with a horizontal line (also serving as the time axis in the FIG. 3*a*) as a typical example, although these four time points of FIG. 3*a* constitute only one measure out of four measures.

When a point or its vicinity (i.e. on the point. on the line or in the space) is designated by the mouse pointer P (ref. FIG. 3*a*) and is dragged upward (ref. FIG. 3*d*) or downward, the pitch of the dragged point (B1 in the case of FIGS. 3*a* and 3*d*) is decided at the dragged destination (solid circle D1 in FIG. 3*d*). The skeleton notes are thus given respective pitches (D1 and D3 in FIG. 3*d*). The line connecting the note points is also dragged together with the dragged point in such a fashion as partially shown in FIG. 2 (first and second measures W1 and W2). The number of skeleton notes (primary or important notes) is one or two for each measure and is predetermined in each music template.

Under the condition that the skeleton points are predetermined, the points on down beats (strong beats) or, in case there is no point on a down beat, the point nearest to the down beat are previously allotted as the skeleton points and no other points are nominated as skeleton points, and the pitch of the predetermined skeleton point which is nearest to the dragged position will be established according to the dragged destination position. Under the condition that the skeleton points are to be arbitrarily nominated, no point is previously nominated as a skeleton point and any point which is nearest to the dragged position will be nominated as a skeleton point. In the latter situation, however, the most recently (the latest) dragged one or two (a limit number depending on the previous setting) points may become the skeleton points. Namely, if the number of skeleton points are limited as two in the displayed one-measure range but three positions are dragged, the last two will be the skeleton points and the first one will be invalidated.

Upon establishment of the pitches of the skeleton notes, the pitches of the remainder of the note time points will be automatically decided to satisfy the musical rules and the composition conditions (as are set for each music template, and include an allowable pitch deviation width) based on the predetermined algorithm. For example, an allowable range of the pitch to be employed for a non-skeleton note is first decided with reference to the neighboring skeleton note pitches and the allowable pitch deviation width (the pitch range between the two adjacent skeleton notes plus the deviation width above and below), and then the pitch of the object non-skeleton note is decided by avoiding non-permitted notes and non-permitted pitch jumps. As the pitch of the note is established, the line connecting such a note is also redrawn.

Figure 12:
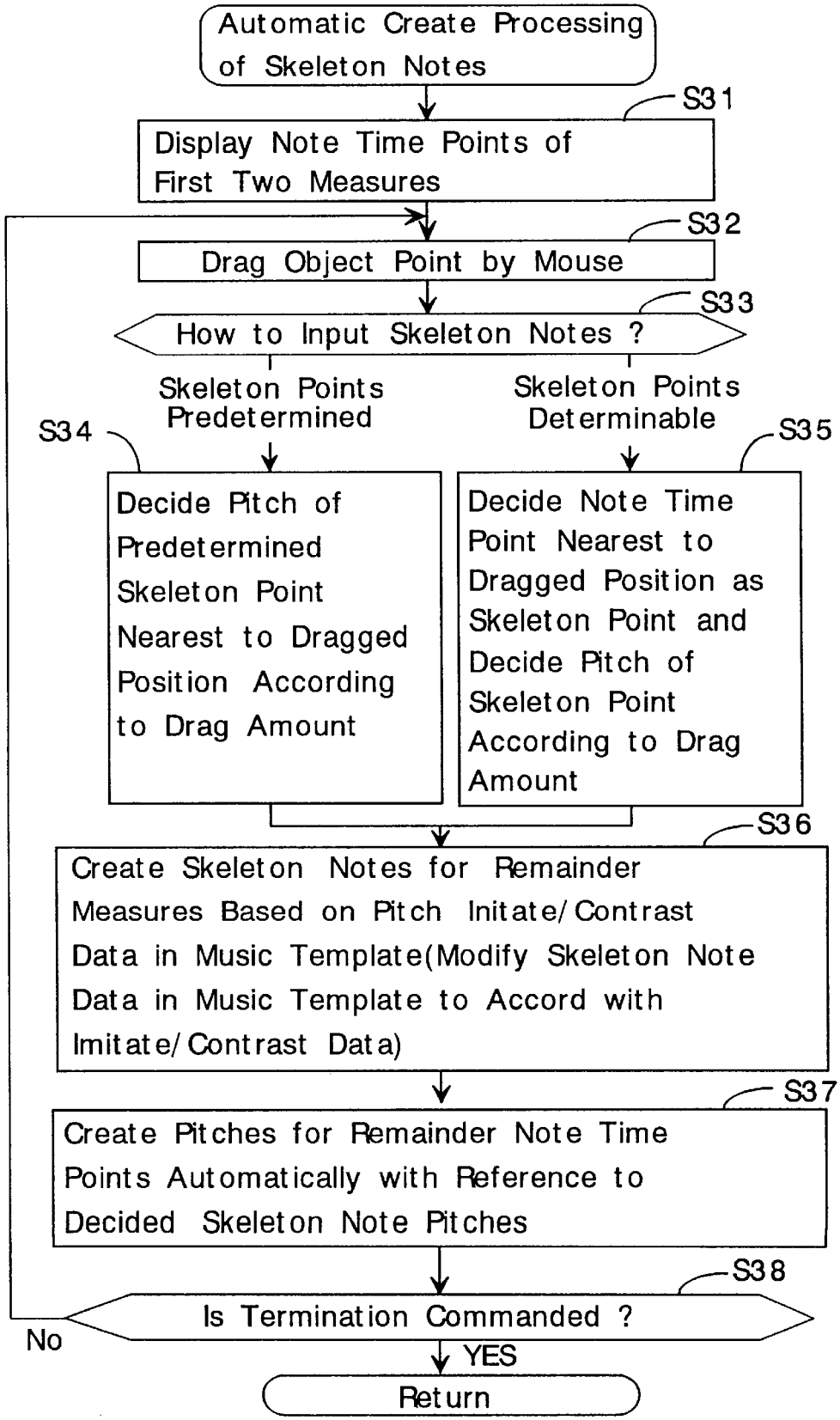
FIG. 12 is a flow chart showing the processing of automatically creating skeleton notes.

FIG. 12 shows a flow chart of the processing of automatically creating skeleton notes, in which a melody motif is manually inputted and the remainder of the melody is created automatically. Steps S31–S35 are the same as the steps S21–25 in FIG. 11 except for the number of measures displayed at the first step, and therefore the detailed description is omitted here. After the pitches of the skeleton notes are decided through dragging the mouse at the step S34 or S35 just like at the step S24 or S25 above, a step S36 creates skeleton notes for the remainder of the measures based on the pitch imitate/contrast data in the music template (by modifying the skeleton data in the music template to accord with the imitate/contrast data). A step S37 then create (establish) the pitches for the remainder of the note time points automatically with reference to the already decided skeleton note pitches, before moving forward to a step S38.

Namely, the steps S36 and S37 create the skeleton notes for the remainder of the measures based on the pitch imitate/contrast data included in the music template so that the skeleton of the inputted melody motif of two measures will be reflected on the whole melody to be composed. More specifically, among the skeleton note data previously included in the music template data, one to several skeleton notes subsequent to the inputted two measures are modified to exhibit a smooth connection to the inputted two measures (avoiding extreme ups and downs), and to exhibit a similar skeleton for the span which is designated to imitate the inputted two measures.

The step S38 judges whether the user has commanded termination of the skeleton note creating processing or not, and in case there is no such a command, the process goes back to the step S32, while in case there is such a termination command, the process returns to the routine of FIG. 10.

Although some particular embodiments are described above, the present invention may be practiced in various modified forms. For example, the method of inputting the note time points may not be limited to tapping, but the note time points may be inputted by clicking the mouse with the pointer placed at the desired position on the screen. Thus inputted points are subject to dragging in the vertical direction (pitch direction) for the establishment of the pitches. A hybrid method is also available, in which the note time points are temporarily inputted by tapping and thereafter are altered along the time axis by dragging the mouse in the horizontal direction or by inserting or deleting a point by a mouse clicking operation.

While in the above described embodiment the pitches of non-skeleton notes are automatically created after the pitch of a skeleton note adjacent thereto is established (decided) with reference to the established pitch of this adjacent note and the pitch of the another adjacent skeleton note (not under dragging), the pitches of the non-skeleton notes adjacent (in both side) to the skeleton note tinder dragging operation may be automatically created every time the point being dragged crosses a pitch level of semitone steps, that is the dragging operation crosses the levels of the C pitch, C♯ pitch, D pitch, and so forth. Alternatively, the pitches of the non-skeleton notes may not yet be imparted at the time the pitches of the skeleton notes have been established, but may be created only when the command for automatically creating the pitches thereof is given by the user.

In the case that all the skeleton note time points have already been determined, the processing may be so designed that the dragging operation off (not "on") a skeleton note point or in its vicinity shall not cause the skeleton note to be given its pitch, whereas the dragging operation on a skeleton note point or in its vicinity shall cause the skeleton note to be given its pitch. Where there is no note time point inputted at a typical position at which a skeleton note would be located, but there is a non-skeleton time point near such a typical position, the non-skeleton time point may be made draggable and be dragged to be given a pitch. The automatically created pitch may be thereafter altered by a mouse operation.

The chord constituent notes, the non-chord-constituent scale notes and the non-scale notes may be classified based on the chord progression data so that the chord notes, the non-chord notes and the non-scale notes may be exhibited in different aspects (colors, shapes, etc.). For inputting a pitch by a dragging manipulation, the drag-destination pitches may be limited to the chord notes or to the scale notes prohibiting other chromatic notes. The user may select whether to place such a limitation or not.

In case the available drag-destination pitches are limited to only the chord notes or to the scale notes for inputting pitches by dragging operation, the time point circle (or other symbol) may be moved only to a pitch level of a permissible pitch (position of a chord note or a scale note as permitted). Then, a small amount of dragging movement of the mouse 6 may not cause a time point circle to be given a pitch (i.e. stay at the drag-off position), and only a sufficient drag amount to reach a permissible pitch (chord note or scale note) will establish a pitch thereof. In such a situation, the manipulation feeling of the mouse will be not good, as the dragged circle would not move to the intended position even for some movement of the mouse. Such inconvenience can be solved by detecting a small movement of the mouse upward or downward and automatically pulling the point circle together with the mouse pointer P to the pitch level of the nearest chord note (or scale note) in the direction of the movement. This will avoid inconvenience of non-movement of the point mark in response to the manipulation of the mouse 6.

Figure 13:
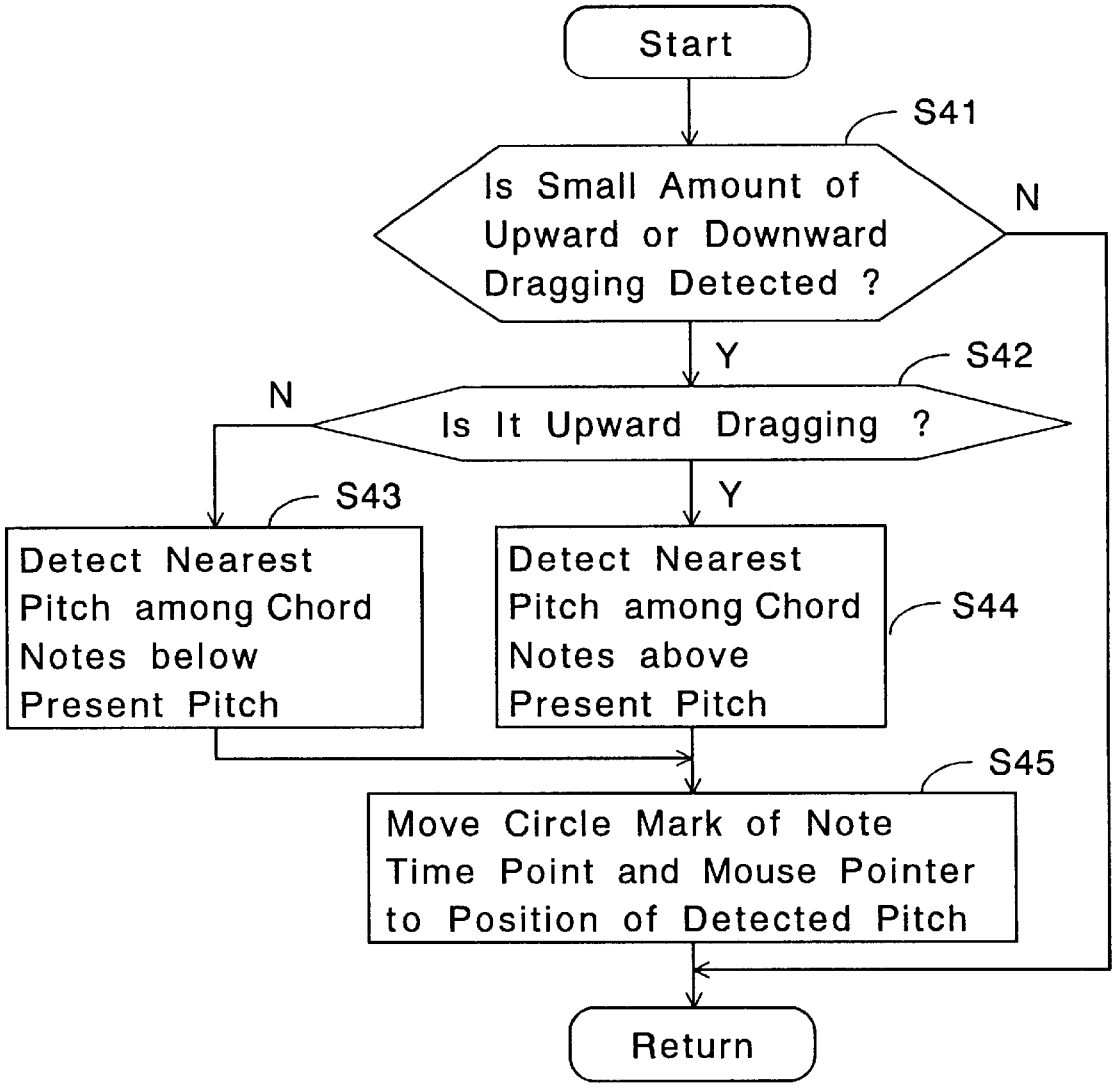
FIG. 13 is a flow chart showing the processing of dragging the note time points to establish pitches thereof where permissible pitches are limited.

FIG. 13 shows a flow chart of the processing of dragging a note time point and giving a permissible level of the pitch in the case of the limited permissible pitches. This processing corresponds to the screen display employed in the steps S24 and S25 of FIG. 11 and in the steps S34 and S35 of FIG. 12, and is performed by a predetermined interrupt process at the time the mouse button is depressed with the mouse pointer mark P is placed on a time point circle. First, a step S41 judges whether the mouse 6 is moved upward or downward in a small amount, and if no such movement is detected, the process returns to the former routine to end this small drag processing, and if such small movement is detected, the process proceeds to a step S42 to judge whether the drag direction is upward. If the judgment is negative (i.e. the direction is downward), a step S43 detects the nearest pitch among the chord notes below the present pitch (reference pitch on the time axis), before moving to a step S45. If the judgment is affirmative, a step S44 detects the nearest pitch among the chord notes above the present pitch, before moving to the step S45. The step S45 places the point circle and the mouse pointer, before returning to the former routine.

Figure 14A:
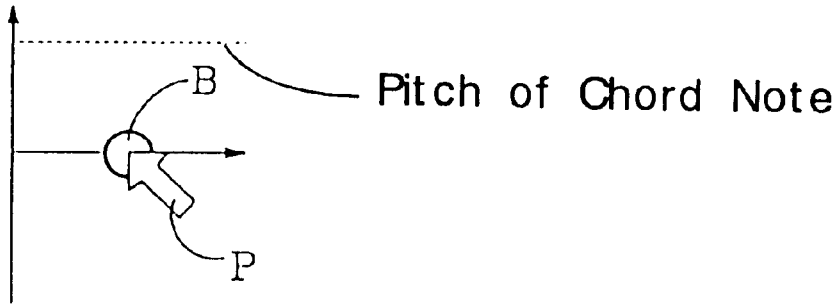
FIGS. 14*a*–14*c* are partial screen shots showing the processing of dragging the note time points according to the flow of FIG. 13.
Figure 14B:
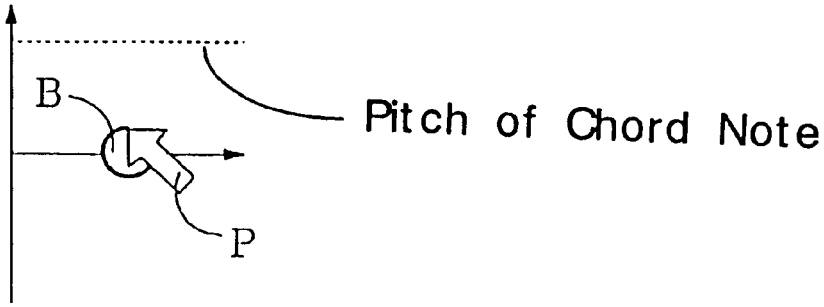

In the above processing routine of FIG. 13, the screen image observed will be as follows as described with reference to FIGS. 14*a*–14*c*, which show partial screen shots of the processing of dragging the note time points. The mouse pointer P is placed on the object circle B and the mouse button is depressed as shown in FIG. 14*a*. As the mouse 6 is moved a little bit, for example upward, with the mouse button kept depressed, the mouse pointer P moves accordingly as shown in FIG. 14*b*. When this amount of small movement reaches a predetermined threshold value, the note time point circle B and the mouse pointer P jumps to the level of the nearest chord note pitch above the original reference level of the time axis. As the circle and the pointer are pulled up to the destination position in the dragging direction, the mouse manipulation feeling will be a comfortable one.

Figure 14C:
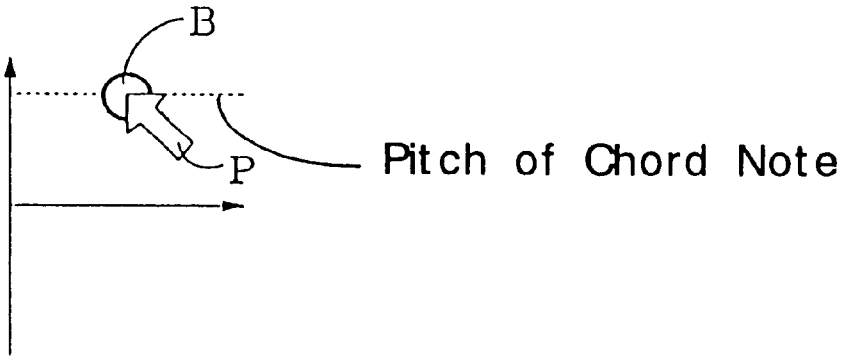

While the description with FIGS. 14*a*–14*c* is the case in which the permitted pitches for the object note point B are those of the chord notes, the permitted pitches may be all of the scale notes plus the chord notes. In such a situation, the step S43 is made to detect the nearest pitch among the scale notes and the chord notes below the present pitch, while the step S44 is made to detect the nearest pitch among the scale notes and the chord notes above the present pitch.

Although the above described embodiment is constructed with a personal computer and software, the present invention is applicable to an electronic musical instrument, too. The tone generator, the sequencer, the effecter, etc. may be separate devices and may be connected with each other or with a central data processing system by appropriate communication means such as MIDI cables and various networks.

The data format for identifying the event and the time in the chord progression data, the melody skeleton note data, the rhythm imitate/contrast data, the pitch imitate/contrast data and the section sequence data included in the music templates; the accompaniment style data; the inputted note time point data; etc. may be an "event+relative time" type which represents the time of an event by a time lapse from the preceding event, or may be an "event+absolute time" type which represents the time of an event by an absolute time position from the top of the music piece or of each measure, or may be a "note pitch (rest)+duration" type which represents the time of an event by the pitch and the duration of each note and by the rest (no pitch) and the duration of a rest, or may be a direct memory mapping type in which memory regions are secured (allotted) for all the available time points under the minimum resolution of time in the automatic music performance and each performance event is written at a memory region which is allotted to the time point of such event, or may be other applicable ones known in the art.

While particular embodiments of the invention have been described, it will be understood, of course, that the invention is not limited thereto since modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. A music data composing apparatus comprising:

an input device for inputting a sequence of note time points representing a plurality of time positions of notes defining a rhythm pattern in a musical progression, thereby providing data representing the sequence of note time points; and a pitch establishing device which establishes pitches of said note time points input with said input device and provides data representing the established pitches of said note time points.

2. A music data composing apparatus as claimed in claim 1, wherein said input device includes a tapping switch to input each of said note time points by tapping.

3. A music data composing apparatus as claimed in claim 2, further comprising:

an automatic accompaniment performing device providing automatic accompaniment data and playing back said automatic accompaniment data presenting an automatic accompaniment to perform an automatic accompaniment for defining beat positions in a musical progression at a given tempo, thereby permitting a user to catch the tempo for a musical progression in inputting said sequence of note time points representing a rhythm pattern by tapping said tapping switch referring to said performed automatic accompaniment.

4. A music data composing apparatus comprising:

an input device for inputting a sequence of note time points representing a plurality of time positions of notes defining a rhythm pattern in a musical progression, thereby providing data representing the sequence of note time points, wherein said input device includes a tapping switch to input each of said note time points by tapping;

a pitch establishing device which establishes pitches of said note time points and provides data representing the established pitches of said note time points;

an automatic accompaniment performing device providing automatic accompaniment data and playing back said automatic accompaniment data representing an automatic accompaniment to perform an automatic accompaniment for defining beat positions in a musical progression at a given tempo, thereby permitting a user to catch the tempo for a musical progression in inputting said sequence of note time points representing a rhythm pattern by tapping said tapping switch referring to said performed automatic accompaniment;

a reference data storing device which stores melody reference data representing conditions for various kinds of melodies and stores accompaniment reference data representing conditions for various kind of accompaniment performances;

a condition selecting device for selecting a desirable condition for the user from among said conditions;

a melody creating device which creates melody data representing a melody based on the melody reference data of the selected condition;

an accompaniment creating device which creates accompaniment data representing an accompaniment based on the accompaniment reference data of the selected condition; and a created data storage device which stores said created melody data and accompaniment data to be composed music data.

5. A music data composing apparatus comprising:

an input device for inputting a sequence of note time points representing a plurality of time positions of notes defining a rhythm pattern in a musical progression, thereby providing data representing the sequence of note time points, wherein said input device includes a tapping switch to input each of said note time points by tapping;

a pitch establishing device which establishes pitches of said note time points and provides data representing the established pitches of said note time points;

an automatic accompaniment performing device providing automatic accompaniment data and playing back said automatic accompaniment data representing an automatic accompaniment to perform an automatic accompaniment for defining beat positions in a musical progression at a given tempo, thereby permitting a user to catch the tempo for a musical progression in inputting said sequence of note time points representing a rhythm pattern by tapping said tapping switch referring to said performed automatic accompaniment; and a display device which displays a picture window of a coordinate plane defined by a time axis for a musical progression and a pitch axis for note pitches, and exhibits said inputted sequence of note time points in an alignment of points in the direction of the time axis.

6. A music data composing apparatus as claimed in claim 5, wherein said pitch establishing device includes a dragging device which drags an intended one of said inputted note time points in said picture window in the direction of the pitch axis and places the dragged point at a position representing a pitch in the direction of the pitch axis, thereby giving the pitch represented by said position to said dragged point.

7. A music data composing apparatus as claimed in claim 6, wherein said pitch establishing device establishes said pitches of the note time points by giving an individual pitch to each of a smaller number, than said plurality, of note time points by manual operations and creating the pitches of the remainder of said plurality of note time points automatically.

8. A music data composing apparatus claimed in claim 7, wherein the note time points to which pitches can be given are predetermined from among the inputted note time points.

9. A music data composing apparatus as claimed in claim 8, wherein said predetermined note time points to which pitches can be given by manual operations are exhibited in said picture window in a manner different from a manner in which other note time points are exhibited.

10. A music data composing apparatus as claimed in claim 7, wherein the number of note time points to which pitches can be given by manual operations are limited among the note time points exhibited in said displayed picture window, and the pitches of the note time points as manually operated latest in said number are made established while the pitches of note time points given by earlier manual operations in said displayed picture window are released from being established manually.

11. A music data composing apparatus as claimed in claim 6, wherein the pitches available to be given for the notes are limited to several of the musical scale notes according to a predetermined rule, and the dragged point is to rest only on a pitch among said limited available pitches.

12. A music data composing apparatus as claimed in claim 5, wherein said pitch establishing device establishes said pitches of the note time points by drawing a pitch curve representing a variation of pitches along the musical progression in said picture window, and by sampling said pitch curve at the note time points, thus determining a pitch of each note time point.

13. A music data composing apparatus comprising:

an adjectival word exhibiting device which exhibits to a user of said apparatus a plurality of adjectival words defining characters of music to be composed;

a adjectival word selecting device for selecting an adjectival word from among said exhibited adjectival words according to a selection by said user; and a music creating device which automatically creates music data representing a musical piece which has the character as defined by said selected adjectival word.

14. A music data composing apparatus as claimed in claim 13, further comprising:

a reference data storing device which stores plural sets of music reference data, each set representing conditions for building music of a character as defined by each of said adjectival words;

a reference data selecting device which selects a set of music reference data corresponding to said selected adjectival word; and a music creating device which creates a piece of music based on said selected set of music reference data.

15. A music data composing apparatus comprising:

an adjectival word providing device which provides a plurality of adjectival words defining characters of music to be composed;

a adjectival word selecting device for selecting an adjectival word from among said provided adjectival words according to a random selection algorithm; and a music creating device which automatically creates music data representing a musical piece which has the character as defined by said randomly selected adjectival word.

16. A music data composing apparatus as claimed in claim 15, further comprising:

a reference data storing device which stores plural sets of music reference data, each set representing conditions for building music of a character as defined by each of said adjectival words;

a reference data selecting device which selects a set of music reference data corresponding to said selected adjectival word; and a music creating device which creates a piece of music based on said selected set of music reference data.

17. A music data composing apparatus comprising:

a first adjectival word exhibiting device which exhibits to a user of said apparatus a first group of plural adjectival words from a first point of view representing characters of music to be composed;

a first adjectival word selecting device for selecting a first adjectival word from among the exhibited first group of adjectival words according to a selection by said user;

a second adjectival word exhibiting device which exhibits to a user of said apparatus a second group of plural adjectival words from a second point of view different from said first point of view representing characters of music to be composed;

a second adjectival word selecting device for selecting a second adjectival word from among the exhibited second group of adjectival words according to a selection by said user; and a music creating device which automatically creates music data representing a musical piece which has the character as defined by both said selected first and second adjectival word.

18. A music data composing apparatus comprising:

a first adjectival word providing device which provides a first group of plural adjectival words from a first point of view representing characters of music to be composed;

a first adjectival word selecting device for selecting a first adjectival word from among said provided first group of adjectival words according to a random selection algorithm;

a second adjectival word providing device which provides a second group of plural adjectival words from a second point of view different from said first point of view representing characters of music to be composed;

a second adjectival word selecting device for selecting a second adjectival word from among said provided second group of adjectival words according to a random selection algorithm; and a music creating device which automatically creates music data representing a musical piece which has the character as defined by said selected first and second adjectival word.

19. A music data composing apparatus comprising:

a first adjectival word exhibiting device which exhibits to a user of said apparatus a first group of plural adjectival words from a first point of view representing characters of a melodies to be composed;

a first adjectival word selecting device for selecting a first adjectival word from among the exhibited first group of adjectival words according to a selection by said user;

a second adjectival word exhibiting device which exhibits to a user of said apparatus a second group of plural adjectival words from a second point of view representing characters of accompaniments to be composed;

a second adjectival word selecting device for selecting a second adjectival word from among the exhibited second group of adjectival words according to a selection by said user;

a melody creating device which automatically creates melody data representing a melody which has the character as defined by said selected first adjectival word; and an accompaniment creating device which automatically creates accompaniment data representing an accompaniment which has the character as defined by said selected second adjectival word.

20. A music data composing apparatus comprising:

a first adjectival word providing device which provides a first group of plural adjectival words from a first point of view representing characters of melodies to be composed;

a first adjectival word selecting device for selecting a first adjectival word from among said provided first group of adjectival words according to a random selection algorithm;

a second adjectival word providing device which provides a second group of plural adjectival words from a second point of view representing characters of accompaniments to be composed;

a second adjectival word selecting device for selecting a second adjectival word from among said provided second group of adjectival words according to a random selection algorithm;

a melody creating device which automatically creates melody data representing a melody which has the character as defined by said selected first adjectival word; and an accompaniment creating device which automatically creates accompaniment data representing an accompaniment which has the character as defined by said selected second adjectival word.

21. A method for composing music data comprising:

a step of inputting a sequence of note time points representing a plurality of time positions of notes defining a rhythm pattern in a musical progression by tapping a switch in said rhythm pattern, thereby providing data representing the sequence of note time points; and a step of establishing pitches of said note time points and providing data representing the established pitches of said note time points.

22. A method for composing music data as claimed in claim 21, further comprising:

a step of displaying a picture window of a coordinate plane defined by a time axis for a musical progression and a pitch axis for note pitches, and exhibiting said inputted sequence of note time points in an alignment of points in the direction of the time axis in said picture window; and wherein said step of establishing pitches includes a substep of dragging an intended one of said inputted note time points in said picture window in the direction of the pitch axis and placing the dragged point at a position representing a pitch in the direction of the pitch axis, thereby giving the pitch represented by said position to said dragged point.

23. A method for composing music data as claimed in claim 22, wherein said step of establishing pitches establishes said pitches of the note time points by giving an individual pitch to each of a smaller number, than said plurality, of note time points by manual operations and by creating the pitches of the remainder of said plurality of note time points automatically.

24. A method for composing music data as claimed in claim 22, wherein said step of establishing pitches establishes said pitches of the note time points by drawing a pitch curve representing a variation of pitches along the musical progression in said picture window and by sampling said pitch curve at the note time points, thus determining a pitch of each note time point.

25. A method for composing music data comprising:

a step of exhibiting to a user of said method a plurality of adjectival words defining characters of music to be composed;

a step of selecting an adjectival word from among said exhibited adjectival words according to a selection by the user; and a step of automatically creating music data representing a musical piece which has the character as defined by said selected adjectival word.

26. A method for composing music data comprising;

a step of exhibiting to a user of said method a first group of plural adjectival words from a first point of view representing characters of music to be composed;

a step of selecting a first adjectival word from among the exhibited first group of adjectival words according to a selection by the user;

a step of exhibiting to the user of said method a second group of plural adjectival words from a second point of view different from said first point of view representing characters of music to be composed;

a step of selecting a second adjectival word from among the exhibited second group of adjectival words according to a selection by the user; and a step of automatically creating music data representing a musical piece which has the character as defined by both said selected first and second adjectival word.

27. A method for composing music data comprising:

a step of exhibiting to a user of said method a first group of plural adjectival words from a first point of view representing characters of a melodies to be composed;

a step of selecting a first adjectival word from among the exhibited first group of adjectival words according to a selection by the user;

a step of exhibiting to the user of said method a second group of plural adjectival words from a second point of view representing characters of accompaniments to be composed;

a step of selecting a second adjectival word from among the exhibited second group of adjectival words according to a selection by the user;

a step of automatically creating melody data representing a melody which has the character as defined by said selected first adjectival word; and a step of automatically creating accompaniment data representing an accompaniment which has the character as defined by said selected second adjectival word.

28. A storage medium storing a program that is executable by a computer, said program comprising:

a module for inputting a sequence of note time points representing a plurality of time positions of notes defining a rhythm pattern in a musical progression by tapping a switch in said rhythm pattern thereby providing data representing the sequence of note time points; and a module for establishing pitches of said note time points and providing data representing the established pitches of said note time points.

29. A storage medium as claimed in claim 28, further comprising:

a module for displaying a picture window of a coordinate plane defined by a time axis for a musical progression and a pitch axis for note pitches, and exhibiting said inputted sequence of note time points in an alignment of points in the direction of the time axis in said picture window; and wherein said module for establishing pitches includes a sub-module for dragging an intended one of said inputted note time points in said picture window in the direction of the pitch axis and placing the dragged point at a position representing a pitch in the direction of the pitch axis, thereby giving the pitch represented by said position to said dragged point.

30. A storage medium as claimed in claim 29, wherein said module for establishing pitches is to establish said pitches of the note time points by giving an individual pitch to each of a smaller number, than said plurality, of note time points by manual operations and by creating the pitches of the remainder of said plurality of note time points automatically.

31. A storage medium as claimed in claim 29, wherein said module for establishing pitches is to establish said pitches of the note time points by drawing a pitch curve representing a variation of pitches along the musical progression in said picture window and by sampling said pitch curve at the note time points, thus determining a pitch of each note time point.

32. A storage medium storing a program that is executable by a computer, said program comprising:

a module for exhibiting to a user a plurality of adjectival words defining characters of music to be composed;

a module for selecting an adjectival word from among said exhibited adjectival words according to a selection by the user; and a module for automatically creating music data representing a musical piece which has the character as defined by said selected adjectival word.

33. A storage medium storing a program that is executable by a computer, said program comprising:

a module for exhibiting to a user a first group of plural adjectival words from a first point of view representing characters of music to be composed;

a module for selecting a first adjectival word from among the exhibited first group of adjectival words according to a selection by the user;

a module for exhibiting to the user a second group of plural adjectival words from a second point of view different from said first point of view representing characters of music to be composed;

a module for selecting a second adjectival word from among the exhibited second group of adjectival words according to a selection by the user; and a module for automatically creating music data representing a musical piece which has the character as defined by both said selected first and second adjectival word.

34. A storage medium storing a program that is executable by a computer, said program comprising:

a module for exhibiting to a user a first group of plural adjectival words from a first point of view representing characters of a melodies to be composed;

a module for selecting a first adjectival word from among the exhibited first group of adjectival words according to a selection by the user;

a module for exhibiting to the user a second group of plural adjectival words from a second point of view representing characters of accompaniments to be composed;

a module for selecting a second adjectival word from among the exhibited second group of adjectival words according to a selection by the user;

a module for automatically creating melody data representing a melody which has the character as defined by said selected first adjectival word; and a module for automatically creating accompaniment data representing an accompaniment which has the character as defined by said selected second adjectival word.

* * * * *